US007770420B2

(12) United States Patent
Carr

(10) Patent No.: US 7,770,420 B2
(45) Date of Patent: Aug. 10, 2010

(54) LOCKDOWN DOOR BAR

(76) Inventor: Ronald R. Carr, 4232 Voice Rd., Kingsley, MI (US) 49649

( * ) Notice: Subject to any disclaimer, the term of this patent is extended or adjusted under 35 U.S.C. 154(b) by 0 days.

(21) Appl. No.: 12/103,042

(22) Filed: Apr. 15, 2008

(65) Prior Publication Data

US 2009/0102205 A1 Apr. 23, 2009

Related U.S. Application Data

(63) Continuation-in-part of application No. 11/874,038, filed on Oct. 17, 2007, now Pat. No. 7,637,130.

(51) Int. Cl.
*E05B 73/00* (2006.01)

(52) U.S. Cl. ..... 70/14; 70/212; 70/416; 292/259 R; 292/288; 292/289; 292/292

(58) Field of Classification Search ..... 70/14, 70/16, 18, 212, 232, 416; 292/259 R, 288–290, 292/292

See application file for complete search history.

(56) References Cited

U.S. PATENT DOCUMENTS 3,545,237 A * 12/1970 Gardella, Jr. et al. ..... 70/16
3,819,216 A 6/1974 Richardson
4,004,833 A 1/1977 Hull
4,099,754 A 7/1978 Hoebing
4,334,705 A 6/1982 Rumph
4,605,251 A 8/1986 Finlay
4,856,831 A 8/1989 Roden, Jr.
4,955,648 A 9/1990 Miller
5,360,245 A 11/1994 David et al.
5,984,380 A 11/1999 Rice
6,018,968 A * 2/2000 Sides ..... 70/14
6,393,878 B1 5/2002 Fayngersh et al.
6,560,925 B1 5/2003 Rice

* cited by examiner

*Primary Examiner*—Suzanne D Barrett
(74) *Attorney, Agent, or Firm*—McGarry Bair PC

(57) ABSTRACT

A door has a doorknob, and is hingedly mounted in a door frame having at least one vertical member. The door is capable of selective rotational movement between a closed configuration and an open configuration. The door has a first side and an opposed second side. The first side is oriented in a direction toward which the door opens. A barricade bar includes a flange member for selectively engaging the doorknob to prevent the separation of the flange member from the doorknob. The barricade bar also includes a frame member for coordinate engagement with the at least one vertical member. The frame member is rigidly coupled with the flange member. The barricade bar can be oriented adjacent the second side of the door so that the frame member engages the vertical member and the flange member engages the doorknob to prevent the opening of the door.

15 Claims, 17 Drawing Sheets

LOCKDOWN DOOR BAR

CROSS-REFERENCE TO RELATED APPLICATION

This application is a continuation-in-part of U.S. patent application Ser. No. 11/874,038, filed Oct. 17, 2007, now U.S. Pat. No. 7,637,130, issued Dec. 29, 2009, which is incorporated herein in its entirety.

BACKGROUND OF THE INVENTION

Description of the Related Art

In light of the current national concern over terrorism and mass shootings in schools and other institutional settings, a relatively standardized procedure for responding to a security threat in a school building has been developed: the "lockdown", in which teachers essentially lock themselves and their students in their rooms to deter invaders and await help.

A problem with the lockdown procedure is that fire safety codes typically mandate the use of outward-opening doors, and the use of locks that are key-locked from outside the room and released by simply turning the doorknob from inside the room. These fire safety measures interfere with the speed and security of the lockdown procedure. The teacher must open the classroom door, step outside, and key the lock, exposing himself and the classroom to danger; a panicky student can easily unlock the door from the inside; and if the door has the typical glass window, a gunman can break the glass, reach inside, and unlock the door by turning the inside doorknob.

SUMMARY OF THE INVENTION

A door has a doorknob, and is hingedly mounted in a door frame having at least one vertical member. The door is capable of selective rotational movement between a closed configuration and an open configuration. The door has a first side and an opposed second side. The first side is oriented in a direction toward which the door opens. A barricade bar includes a flange member for selectively engaging the doorknob to prevent the separation of the flange member from the doorknob. The barricade bar also includes a frame member for coordinate engagement with the at least one vertical member. The frame member is rigidly coupled with the flange member. The barricade bar can be oriented adjacent the second side of the door so that the frame member engages the vertical member and the flange member engages the doorknob to prevent the opening of the door.

DETAILED DESCRIPTION OF EMBODIMENTS OF THE INVENTION

Figure 1:
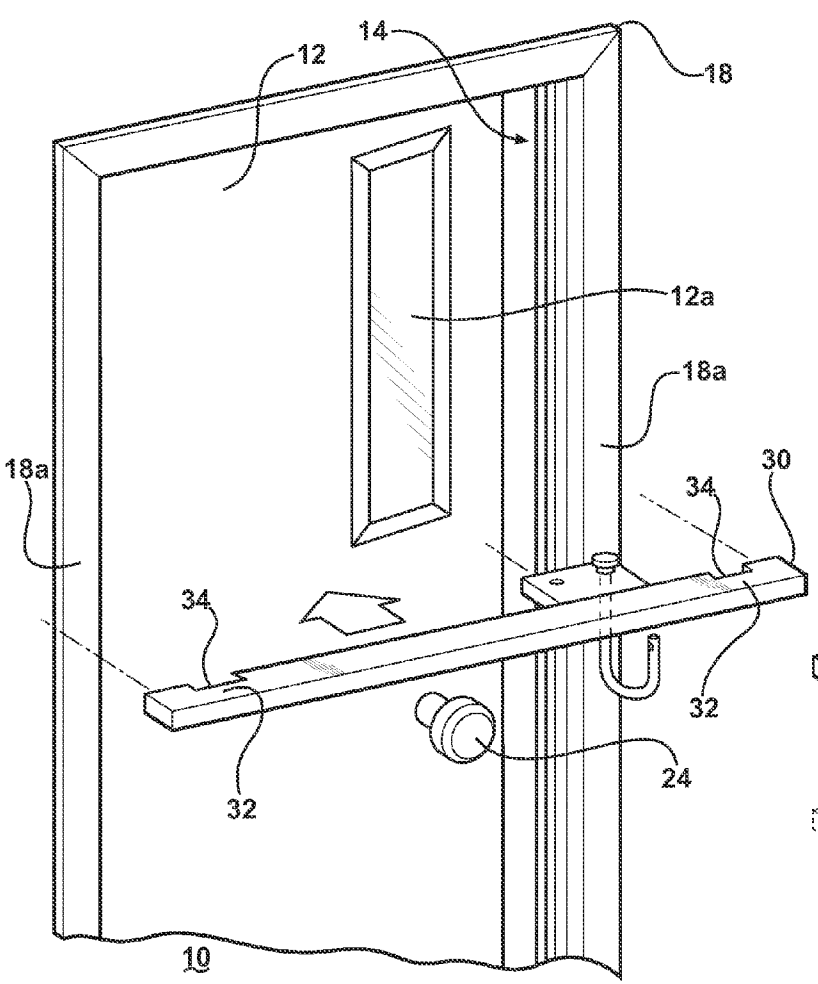
FIG. 1 is a perspective view, from inside a room, of a partially open, outward-opening door with an external key lock, and the barricade bar of the present invention shown prior to applying it to the door.

Referring first to FIG. 1, the invention is illustrated in a preferred example from the perspective of a school classroom 10, with an outward-opening door 12 separating the room from outer hallway 14. Door 12 is mounted in a typical doorframe 18 with protruding vertical sides 18*a*. Door 12 has a doorknob 24, with an outer doorknob (not shown) having an external lock operated by a key. The inner doorknob 24 is without locking features. Door 12 can only be locked via the lock in the outer knob, and this requires someone in room 10 with a key to first open the door when a lockdown is initiated. Once the locked door is pulled closed (FIG. 2), the door is normally unlocked by simply turning inner knob 24, in known fashion.

In the case of a violent intruder, possibilities for gaining access to classroom 10 include interrupting the locking procedure while the door 12 is still open; inducing someone inside to unlock the door via inner knob 24; obtaining a key by force or fraud (or using a key accidentally left in the lock in the outer knob); or, if door 12 is provided with a window such as 12*a*, either built into the door as shown or in the wall next to it, breaking the window and reaching through to operate inner knob 24. The present invention addresses all of these potential weaknesses in the typical lockdown procedure with a barricade bar 30 that locks the inner knob 24 to the doorframe 18.

FIGS. 1 through 4 illustrate a preferred example of barricade bar 30. FIG. 1 shows barricade bar 30 being applied to doorframe 18 by orienting the bar horizontally and pushing the bar 30 axially against the doorframe (as shown by the projection lines and arrow in FIG. 1) to pre-position the bar above the inner doorknob 24. Barricade bar 30 is portable, with a length approximately equal to the width of the doorframe, and so can be easily stored in a corner of the classroom, in a closet, on a wall bracket, or on a bracket concealed under a teacher's desk. Barricade bar 30 has doorframe-engaging ends 32, shaped at 34 to allow the bar 30 to fit over and engage the doorframe sides 18*a* (including any trim over or integral with the frame) in a non-rotating manner. It will be understood by those skilled in the art that the bar's ends 32 can be adapted to fit different types of doorframes, whether the vertical sides of the doorframe protrude from the surrounding doorway (best shown in FIGS. 7 and 7A), or are recessed within the doorway (shown in FIG. 11 at reference numeral 118*a*), provided that bar 30 spans the doorway, i.e. axially engages at least one (and preferably both) of the sides of the doorframe in a non-rotating manner when engaged with the doorknob to prevent the bar from being pulled outwardly through the doorway.

Barricade bar 30 can be made from many different materials, including wood and plastics, but metals such as steel and aluminum are preferable. It will be understood by those skilled in the art that although a generally flat, rectangular bar is illustrated and preferred, the term "bar" is not intended to exclude other shapes and cross-sections, such as bars with rounded cross-sections or the thicker, more block- or plate-like "bars" shown in FIGS. 12A and 12B.

Figure 2:
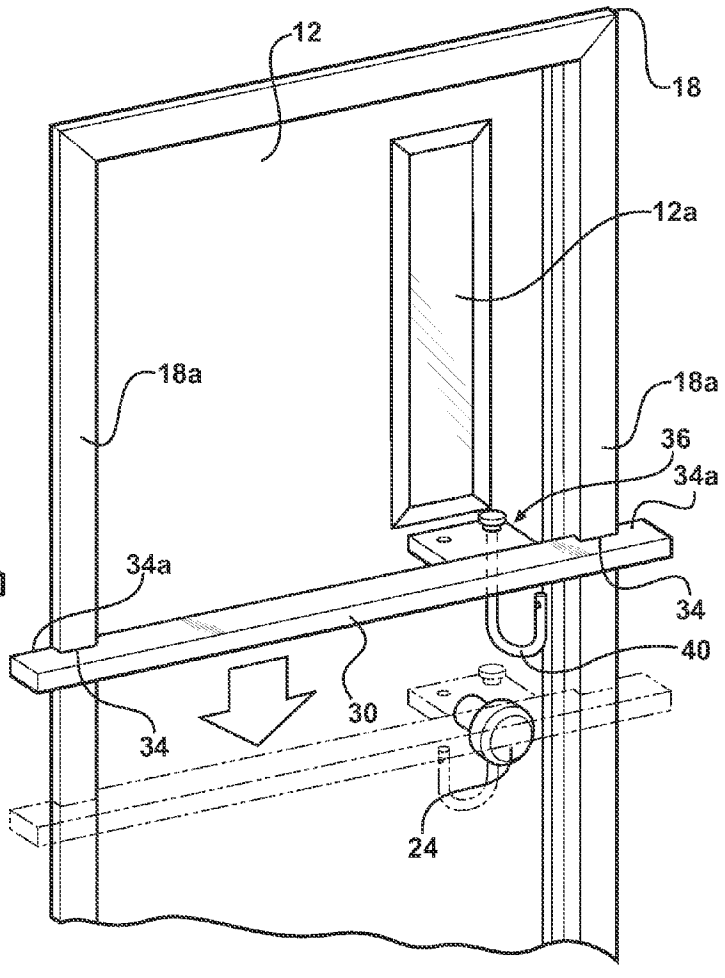
FIG. 2 is similar to FIG. 1, but with the door closed, and the barricade bar shown pre-positioned on the doorframe above the inner doorknob in solid lines, and shown lowered into initial engagement with the doorknob in phantom lines.

FIG. 2 shows barricade bar 30 pre-positioned on the doorframe, with ends 32 engaged with the vertical sides 18*a* of the doorframe above inner doorknob 24, and with a clamping member 40 in a storage position to one side of the doorknob 24. Ends 32 fit over and engage the doorframe sides 18*a* in a manner that prevents bar 30 from rotating in the vertical plane out of its horizontal, doorframe-spanning position, and that allows bar 30 to be guided down in sliding fashion along sides 18*a* onto inner doorknob 24, as shown by the arrow in FIG. 2. While there are many possible ways to form ends 32, recessed channels, lips, or half channels such as 34 approximating the contour of the doorframe, and/or flanges such as 34*a* extending inwardly toward the wall or door, are preferred for initially guiding the ends of the bar 30 onto the doorframe 18 and for preventing rotation of the bar on the doorframe once engaged.

Figure 3:
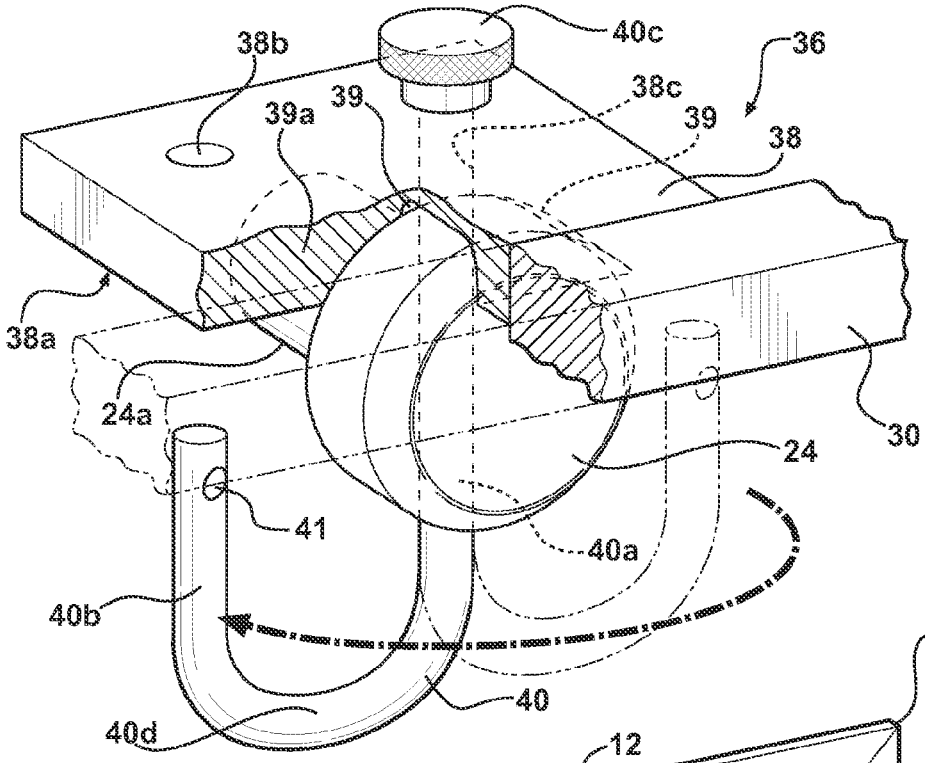
FIG. 3 is a detailed perspective view of the clamping mechanism of FIG. 2 in its initial engagement with the inner doorknob.

FIG. 2 shows barricade bar 30 initially engaged with inner doorknob 24 in phantom lines after sliding bar 30 down along the doorframe. FIG. 3 is a close-up view of the clamping member 40 moved to a pre-clamping position aligned with doorknob 24. Clamping member 40 is part of a clamping mechanism 36 that also includes a doorknob-engaging platform 38 located between the ends of the bar, platform 38 extending inwardly toward and aligned over the inner doorknob 24. The generally U-shaped clamping member 40 (shown in a preferred "J" configuration) is slidably mounted for vertical movement in the platform 38, and normally rests in a "down" storage position as shown in FIGS. 2 and 3 that allows platform 38 to be initially engaged with the doorknob 24.

In the illustrated embodiment of FIGS. 1-3, platform 38 is formed as a block or plate attached to or integrally formed with bar 30. Platform 38 has a recess, slot, or cutout 39, in the illustrated embodiment a blind semi-circular recess (best shown in FIG. 3) opening onto the platform's lower surface 38*a*. The recess 39 is sized and shaped to engage the upper half of inner doorknob 24 above stem 24*a*. Accordingly, as barricade bar 30 slides down the doorframe, recess 39 drops onto and mates with the upper portion of doorknob 24, temporarily holding the non-rotating bar 30 in place and freeing the user's hands to operate the clamping mechanism. Because the inner wall or flange 39*a* of recess 39 is interposed between the knob and the door, platform 38 not only vertically supports bar 30 on the doorknob, but also axially connects the doorknob 24 to bar 30 for a temporary barricade that resists the door being pulled open.

The length of bar 30, the shape of its doorframe-engaging ends 32, and the location and dimensions of clamping mechanism 36 can be manufactured to fit a specific door/frame/knob combination. However, because doorframes can vary, and because doorknob styles and sizes can also vary, the interfaces between doorframe 18, bar 30, and doorknob 24 can vary; bar 30 can be adjustable in length; and platform 38 can be attached to bar 30 in removable and/or adjustable fashion. For example, the platform 38 can be connected to bar 30 with bolts (FIG. 7A) extending from the front face of bar 30 through the bar and into threaded bores in the platform 38. If the size and/or shape of doorknob-engaging recess 39 does not properly fit the inner doorknob 24, or if the size or shape of platform 38 or recess 39 does not match the doorknob, platform 38 can be moved to a different location on the bar 30 in better alignment with the doorknob, or it can be detached and a different platform can be substituted.

FIG. 3 illustrates clamping member 40 as a generally U-shaped (more particularly a J-shaped) rigid cylindrical bar, made from a high quality hardened steel. Clamping member 40 is slidably mounted for vertical movement on platform 38, with its two legs 40*a* and 40*b* sliding in corresponding vertical bores or holes 38*b* and 38*c* formed in the platform. The longer leg 40*a* of the "J" is slidably trapped in platform 38 by a stop member 40*c* at its upper end, for example a nut or disc, so that clamping member 40 is retained in the platform 38 in its "down" position when the barricade bar 30 is in storage and while the bar 30 is being deployed. The shorter leg 40*b* of the J-shaped clamping member preferably ends below platform 38 and bar 30 when in the "down" position shown in FIG. 3, so that it can be swiveled from the doorframe-engaging position shown in FIG. 2 to the pre-clamping position of FIG. 3.

It will be understood that the term "U-shaped" as applied to clamping member 40 is meant to include any shape extending below platform 38 to form a loop capable of being substantially closed around the doorknob stem to trap the doorknob below the platform, whether the loop is rounded or squared, and includes the preferred J-shape shown in FIGS. 1-4. It will also be understood that reference to platform body 38 as a block or plate is not intended to limit it strictly to a particular shape, since different shapes or thicknesses will be suitable as long as the platform 38 has sufficient strength and size to engage or at least overlie the upper part of the doorknob 24, and to provide a secure platform for clamping member 40. For J-shaped clamping members, it is helpful to lengthen the bores in which the clamping member slides up and down in the platform plate, in order to reduce the tendency of the long leg 40*a* of the clamping member to cock-up or bind and stick in bore 38*c* before the shorter leg 40*b* arrives in bore 38*b*.

Figure 4:
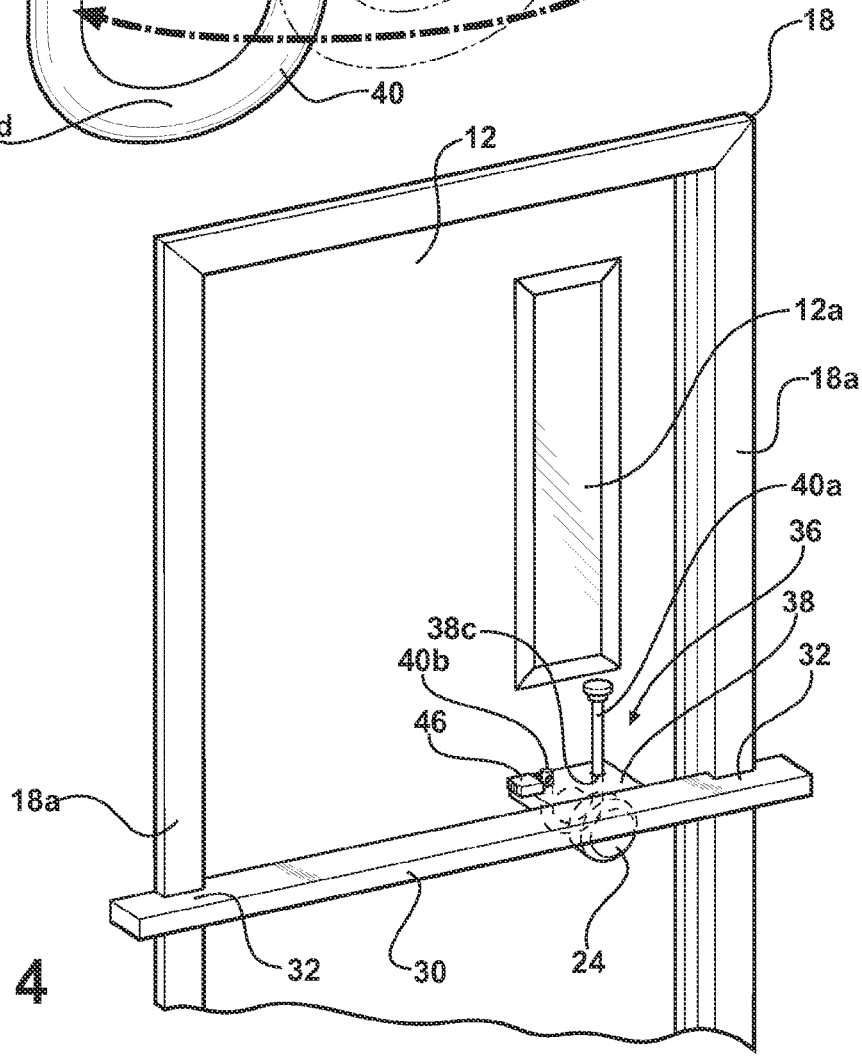
FIG. 4 is a perspective view of the barricade bar of FIG. 1, with the clamping mechanism fully engaged with the inner doorknob and locked in place.
Figure 4A:
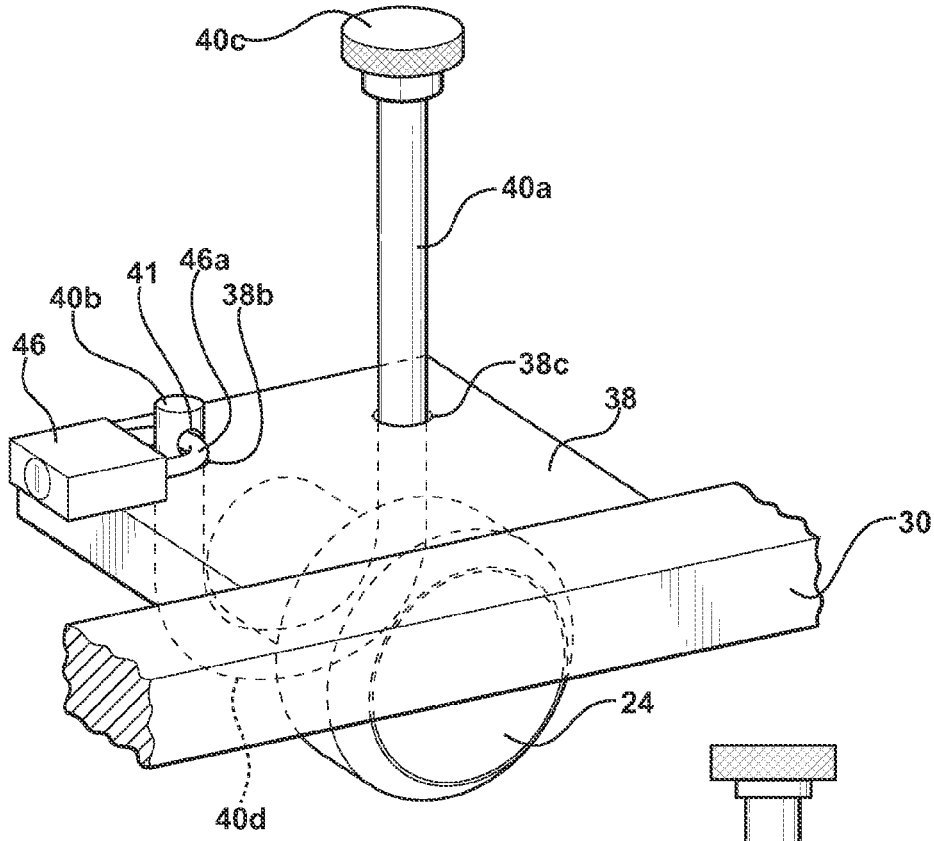
FIG. 4A is a detailed perspective view of the fully engaged and locked clamping mechanism of FIG. 4.

FIGS. 4 and 4A show clamping mechanism 36 fully engaged with doorknob 24. While platform 38 rests on and temporarily holds the upper half of doorknob 24, clamping member 40 is pushed or pulled upwardly from its pre-clamping position (FIG. 3) to its clamping position (FIGS. 4 and 4A), so that short leg 40*b* rides up into the matching bore 38*b* in platform 38, and so that its loop or bight 40*d* rides up behind the lower half of doorknob 24 underneath doorknob stem 24*a*, between the knob and the door. It is preferred that the loop or bight 40*d* engage the inner face of the doorknob 24 in a tight wedge- or cam-fit in this raised position (see FIG. 8), in order to generate forces that tend to further press the ends of bar 30 against the doorframe, and to prevent any movement of the door once clamped. The J-shaped clamping member 40 accordingly can no longer swivel out of engagement with the doorknob 24, and bar 30 cannot be lifted vertically back up the doorframe to disengage platform 38 from doorknob 24. Clamping member 40 is then locked in this raised, clamping position with any of a number of locking means, in the illustrated example of FIG. 4 with a simple padlock 46 whose shackle 46*a* is inserted through a hole 41 formed through leg 40*a* at a location that exposes hole 41 above the upper surface of platform 38 in the clamping position.

Still referring to FIG. 4, anyone outside room 10 trying to pull door 12 open simply forces the ends 32 of bar 30 more tightly against the doorframe 18 via the inner doorknob's engagement with clamping mechanism 36. Lock 46 on clamping member 40 prevents the bar from being unlocked and lifted off doorknob 24 by an intruder reaching through a broken glass window, or by unauthorized or frightened people inside the room. The preferred wedge fit of the clamping member against the back face of the doorknob also prevents an intruder from rattling or shaking the door back and forth to generate any impact force or gaining any leverage against the bar and clamp and doorknob. In the most preferred form, the rear edge of the platform plate 38 is a close fit against the door to further prevent leverage that could potentially break the doorknob.

Figure 5:
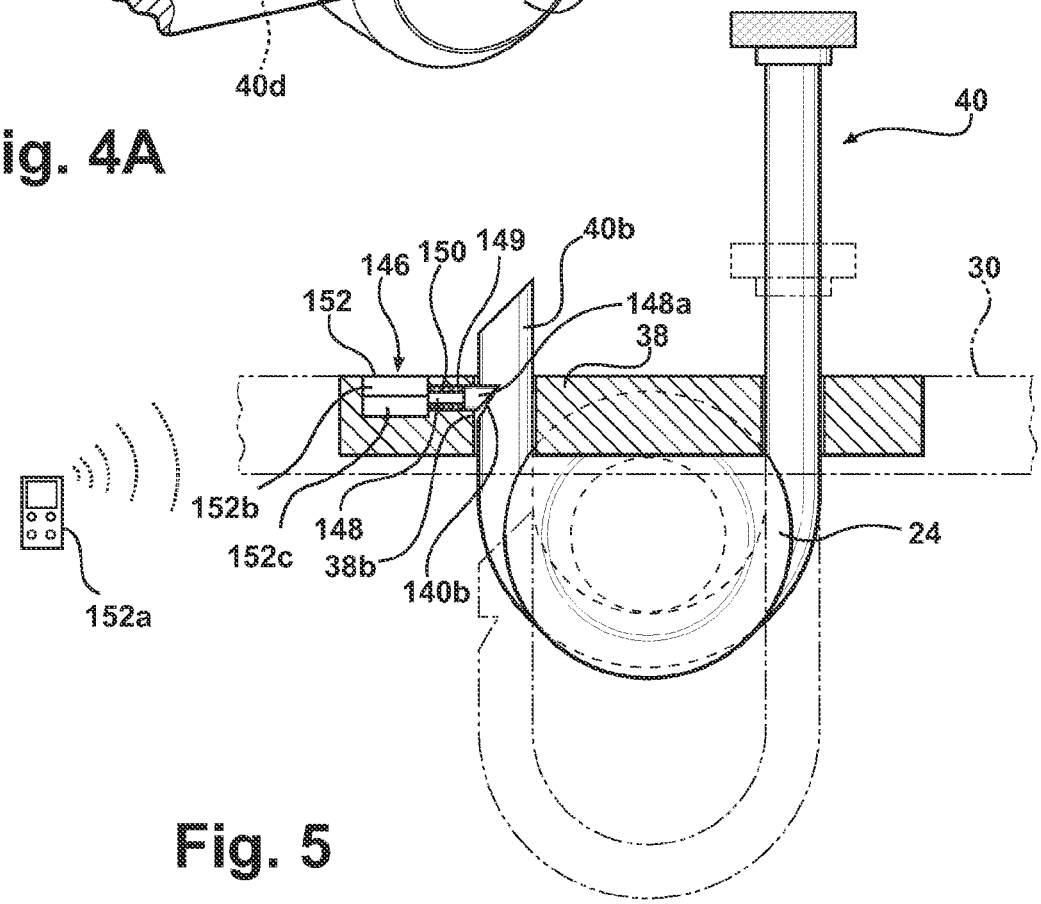
FIG. 5 is a front elevation view showing an alternate, automatically engaged and remotely released lock for locking the clamping mechanism to the doorknob.

In order to further prevent the possibility of the barricade bar being unlocked from inside the room, or by someone reaching through a broken window with a key to the padlock 46, and to increase the speed of the bar's deployment, an alternate, automatically-engaged locking mechanism 146 is illustrated in FIG. 5. Automatic lock mechanism 146 includes a transverse latching member 148 mounted to move in a bore 149 in bar 30. Transverse bore 149 opens into the vertical bore 38*b* that the short clamping member leg 40*b* enters during the clamping operation. Locking pin 148 is normally biased by a spring 150 to extend partway into vertical bore 38*b*, until it is pushed back (leftward in the drawing) by the upward movement of clamping member leg 40*b*, assisted for example by an angled cam surface 148*a* formed in the free end of the pin. Leg 40*b* is modified with a detent or through-hole 140*b* located to receive pin 148 when clamping member 40 is fully engaged, automatically locking the clamping member in place in a tamperproof manner.

Still referring to FIG. 5, pin 148 and spring 150 are part of a remote-controlled, solenoid-retracted unlatching mechanism 152 mounted on or in platform 38, similar for example to those used in remote-controlled automobile door lock mechanisms. The unlatching mechanism 152 can comprise a wireless transmitter 152*b*, which can communicate with a wireless receiver 152*c*, under the control of a controller or microprocessor 152*a*. Transmitting an "all-clear" signal to locking mechanism 146 causes solenoid 152 to retract pin 148 out of engagement with clamping member 40, against the force of the spring, allowing the clamping member to drop freely back down to its pre-clamping position, where it can be swiveled out of alignment with the doorknob to remove barricade bar 30 from the door and doorframe. The wireless unlatching signal can come from a handheld remote control 152*b* in the possession of a teacher, or from security personnel clearing the building, or can be a building-wide signal transmitted from a central office.

It will also be understood that while a remote-control, radio-operated type release is the preferred embodiment shown schematically in FIG. 5, a manually-operated release is also possible, for example a key-lock or keypad of generally known type built into bar 30 or plate 38 and capable of retracting spring-loaded latching member 148 with the turn of a key or the entry of a combination. It will also be understood that the spring-loaded latching member could be built into the clamping member, for example a ball-type detent in leg 40*b*, latching with a suitable recess in bore 38*b* and releasable with a shim.

Figure 6:
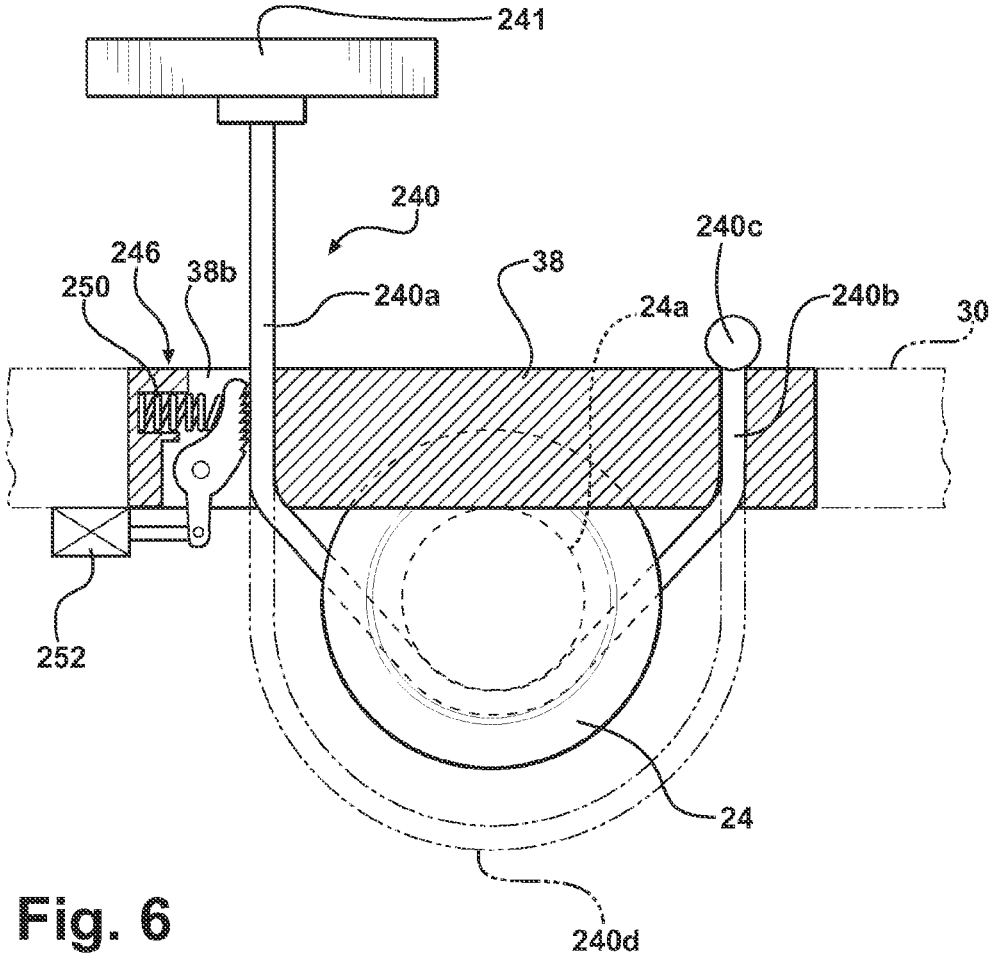
FIG. 6 is a front elevation view similar to FIG. 5, but with an alternate form of clamping member using a flexible cable.

FIG. 6 illustrates an alternate clamping member 240 with a different type of automatic locking mechanism 246. Clamp 240 is a flexible, generally U-shaped member whose short leg 240*b* is fixed to platform 38, for example with an end stop 240*c*, and whose long leg 240*a* terminates in a pull handle 241. In the preferred, illustrated embodiment, clamp 240 is a cut-resistant steel cable, although other flexible members could be used depending on the desired strength of the clamp. Cable clamp 240 normally hangs down in a rest position during storage, as shown in phantom. Although pull handle 241 could be designed to be inserted through bore 38*b* in platform 38 during an emergency, it is preferred that long leg 240*a* normally remain in bore 38 with pull handle 241 resting on top of the platform. The width of the loop portion 240*d* hanging below platform 38 is preferably greater than the width of the doorknob, allowing bar 30 to be engaged axially over the doorknob; the flexibility of cable 240 allows bar 30 to be engaged vertically with the doorknob as shown in FIG. 2 by moving the loop 240*d* out of the way of the doorknob as barricade bar slides down the doorframe 18.

Once pre-engaged with the doorknob (phantom lines in FIG. 6), pull handle 241 is pulled upwardly, drawing the slack in loop 240*d* up through bore 38*b* until the cable engages the doorknob stem (solid lines in FIG. 6). Cable clamp 240 is preferably locked in place with an automatic locking mechanism such as the one shown schematically at 146. A one-way toothed cam 248 is biased by a spring 250 into constant contact with the cable. Cable 240 can accordingly be pulled up through platform 38 to tighten loop 240*d* against the doorknob stem, but cannot be retracted to unlock the bar 30 from the doorknob unless the cam 248 is released, for example with a solenoid unlatching mechanism 252 operated by a remote control signal as described above, or with a key, or both.

Figure 7:
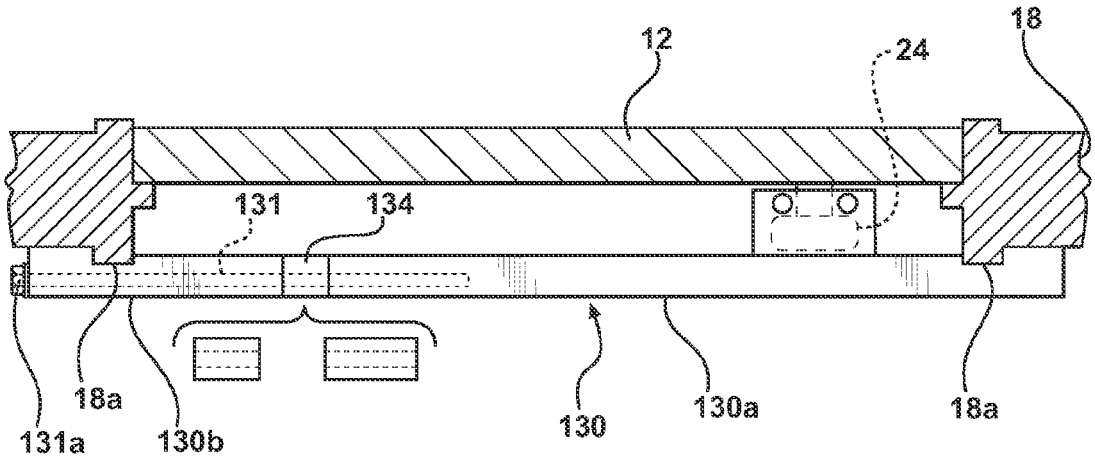
FIG. 7 is a plan view of the doorframe and the installed, locked barricade bar of FIG. 1, illustrating an optional length adjustment for the bar.

FIG. 7 shows a modified barricade bar 130 whose length can be adjusted to fit different doorframes. Bar 130 has two main sections, 130*a* and 130*b*, joined by an adjustment bolt 131 extending through aligned bores formed in the bar sections, and with an exposed head 131*a* at one end of the bar. The bore in the longer main bar portion 130*a* is at least partially threaded so that operating the bolt 131 serves to either draw the bar sections together or force them apart, depending on the direction the bolt is rotated. One or more spacer sections 134 with matching bores are provided to insert between main bar sections 130*a* and 130*b* as needed to accommodate different doorframe widths. Once bar 130 has been lengthened or shortened to match the doorframe 18, the bar is ready to be stored for use in an emergency. While a bolt-operated length adjustment for bar 130 is shown, it will be understood that other forms of length adjustment could be used.

Figure 7A:
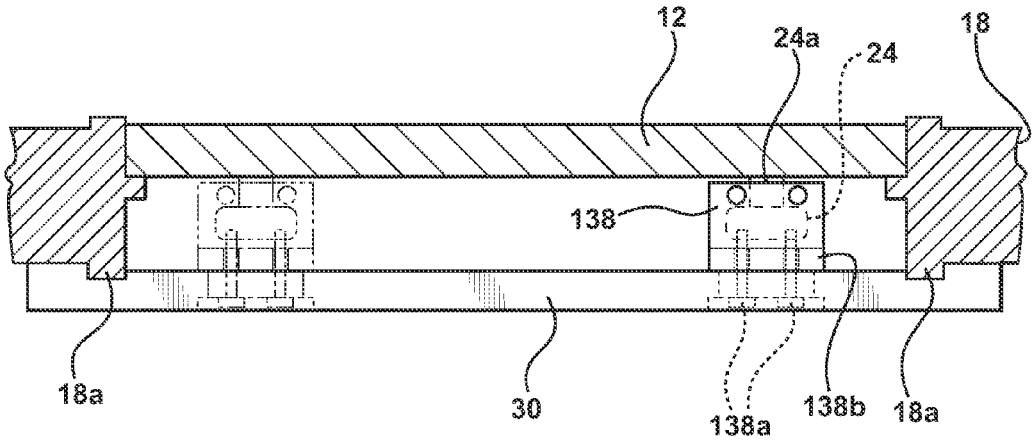
FIG. 7A is a plan view similar to FIG. 7, but illustrating an optional position adjustment for the doorknob-engaging platform.

FIG. 7A shows a barricade bar with a modified doorknob-engaging platform 138, in which the platform is attached to bar 30 with two adjustable bolts 138*a* extending through bar 30, and including one or more spacers 138*b* that can be added and removed to platform 138 as needed to adjust the distance platform 138 extends toward door 12 to properly overlie and engage doorknob 24. By placing multiple sets of holes or slots for bolts 138*a* along the length of bar 30, the position of platform 138 along the length of bar 30 could also be adjusted, as shown in phantom.

Figure 8:
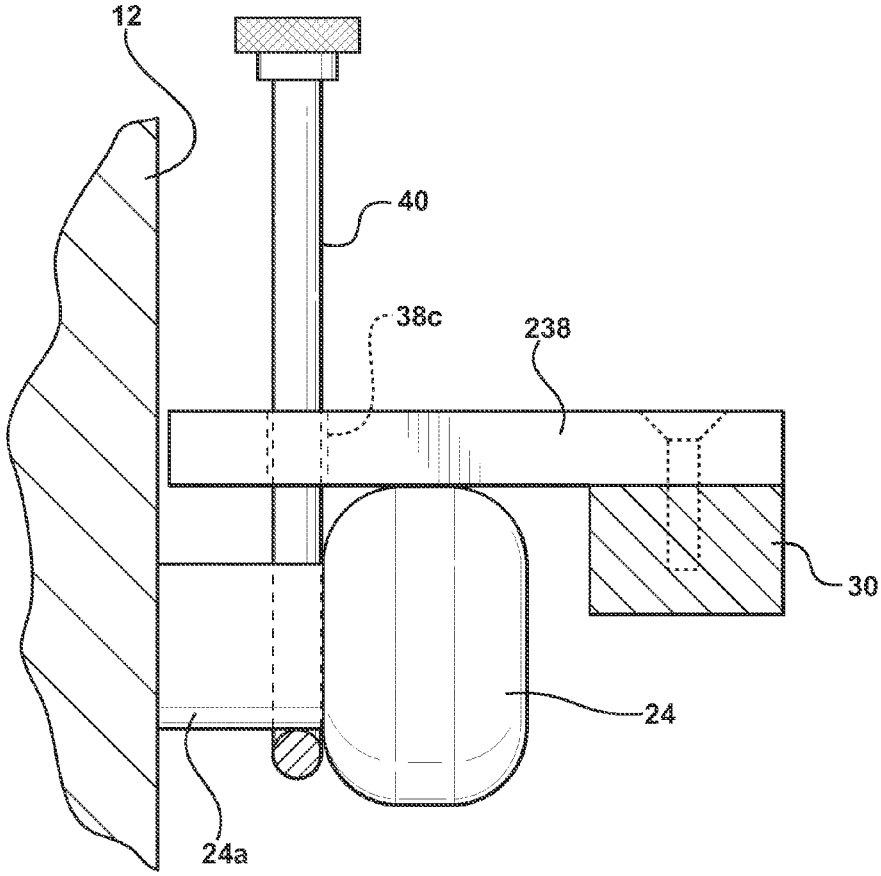
FIG. 8 is a side elevation view showing a first alternate embodiment of the doorknob-engaging platform.

FIG. 8 illustrates another modified doorknob-engaging platform 238. Platform 238 is essentially a flat piece that merely rests on top of doorknob 24 in the pre-engaged position. If sized and balanced properly, this might still allow barricade bar 30 to temporarily stay in place on the doorframe 18 and knob 24 while the clamping member 40 is being engaged and locked, but would not prevent the door 12 from being pulled open until the clamping member is engaged. Flat platform 238 has the advantage of being compatible with most styles of doorknob.

Figure 9:
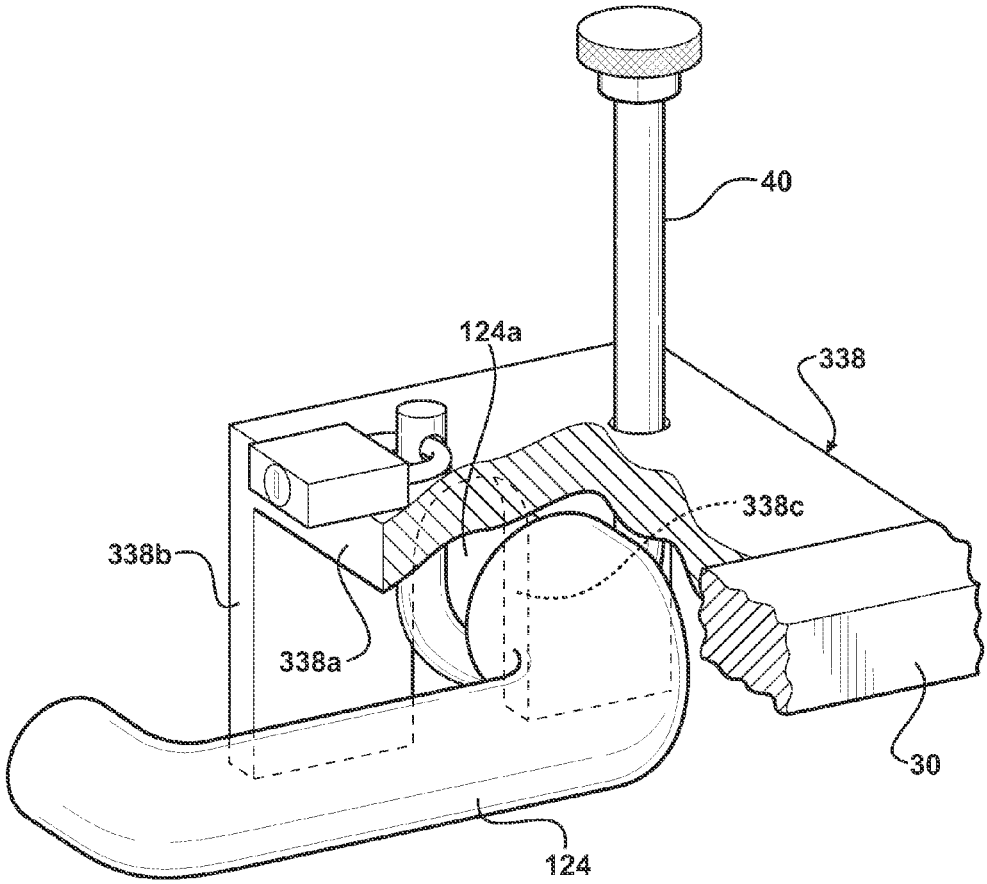
FIG. 9 is a perspective view, similar to FIG. 3, but showing a second alternate embodiment of the doorknob-engaging platform, in use with a lever-handle type doorknob.

FIG. 9 illustrates yet another modified doorknob-engaging platform 338, in which a flat horizontal platform plate 338*a* is provided with a vertical, downwardly-extending flange 338*b* interposed between the rear face of the doorknob and the door. In the case of a lever type handle such as 124, flange 338*b* is located behind the handle portion, and is preferably wide enough to be slotted at 338*c* to drop down over the doorknob stem 124*a* to extend below the handle 124 between the handle and the door. This modified platform 338 strongly resists the door being pulled open even before the clamping member 40 has been engaged and locked. The downwardly extending flange 338*b* also helps hold the bar at rest on the doorknob while any clamping member and lock are being engaged. In some cases, for the simplest application of the bar to the door, it might be sufficient to simply drop the flange-equipped bar into place without a separate clamping member and lock, for an expedient barricade.

Figure 10A:
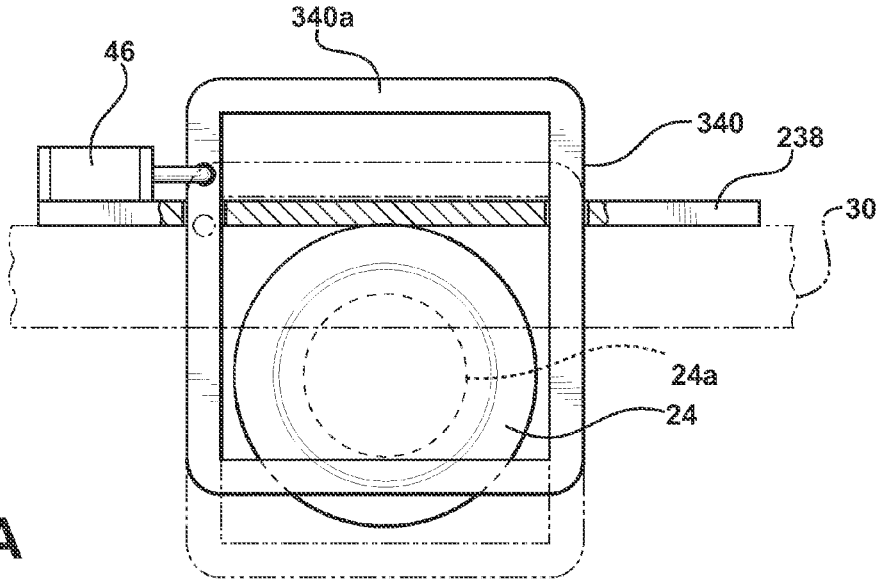
FIGS. 10A-10C are front elevation views, similar to FIG. 5, showing alternate embodiments of U-shaped clamping members.
Figure 10B:
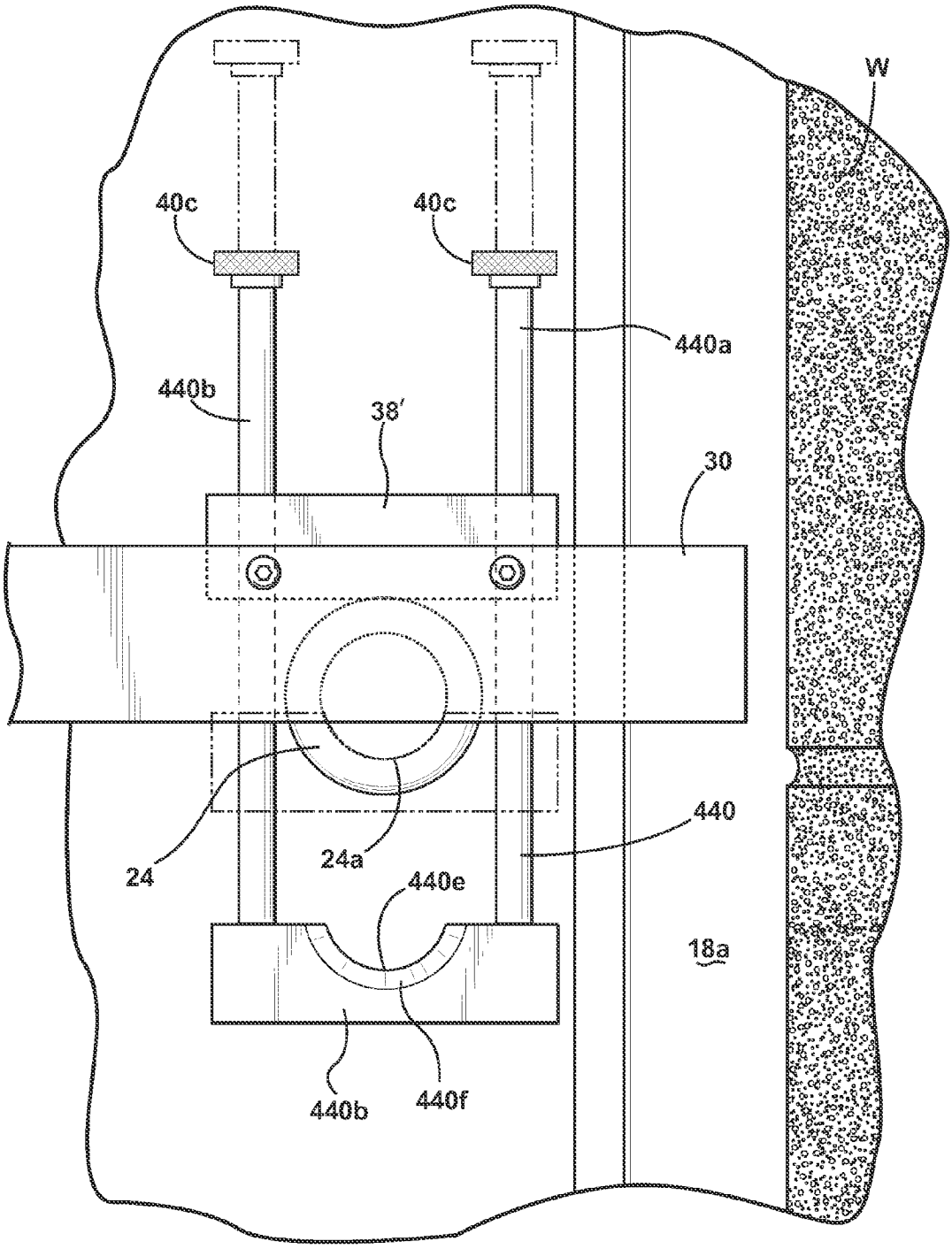
Figure 10C:
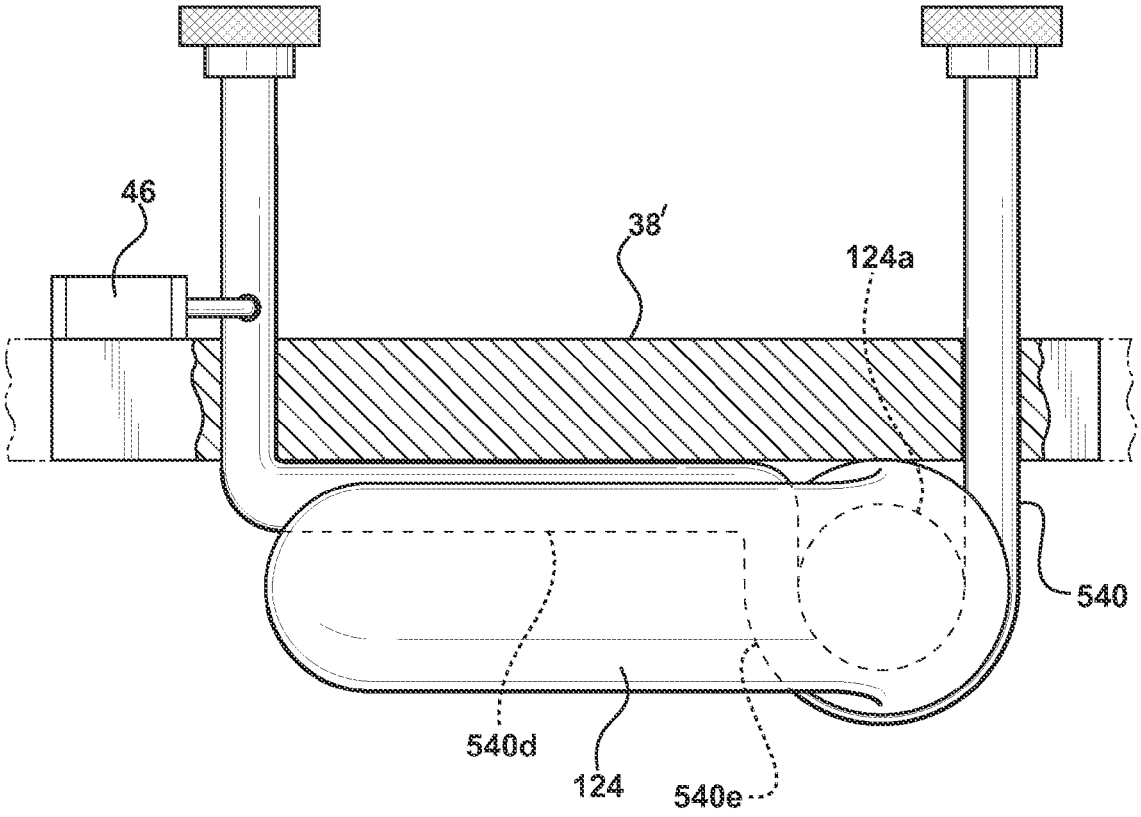

FIGS. 10A through 10C illustrate alternate U-shaped rigid clamping members 340 and 440 and 540, trapped for vertical sliding movement in the platform plate 38. The clamping members have vertical legs of equal length, trapped in platform plate 38 with stops such as 40*c* on their upper ends (FIGS. 10B and 10C), or with a bar portion 340*a* connecting the ends of the vertical legs (FIG. 10A). The widths or diameters of their loop portions below bar 30 are wider than the doorknob, and in the case of clamping member 540 in FIG. 10C the loop portion 540*d* is provided with a narrower secondary loop portion 540*e* adapted to engage the stem 124*a* for a lever style handle, while the horizontal portion 540*d* rides up behind the horizontal portion of handle 124 either flush with the bottom of the platform plate, and preferably even recessed into a channel in the platform plate, to prevent prying. Clamping members 340 and 440 and 540 accordingly remain in axial alignment with doorknob 24, requiring them to be initially engaged with the doorknob 24 in an axial direction while in the "down" position shown in phantom lines, rather than applied in a vertically downward direction and then swiveled into clamping engagement with the doorknob as with the J-shaped swiveling member shown in FIGS. 1-4. Clamping member 440 in FIG. 10B uses a yoke 440*d* with a rounded recess 440*e* to engage the doorknob stem 24*a*, rather than a rounded loop or bight portion, and the yoke can be chamfered at 440*f* on its front face to facilitate a wedge fit against the back of the doorknob.

Figure 11:
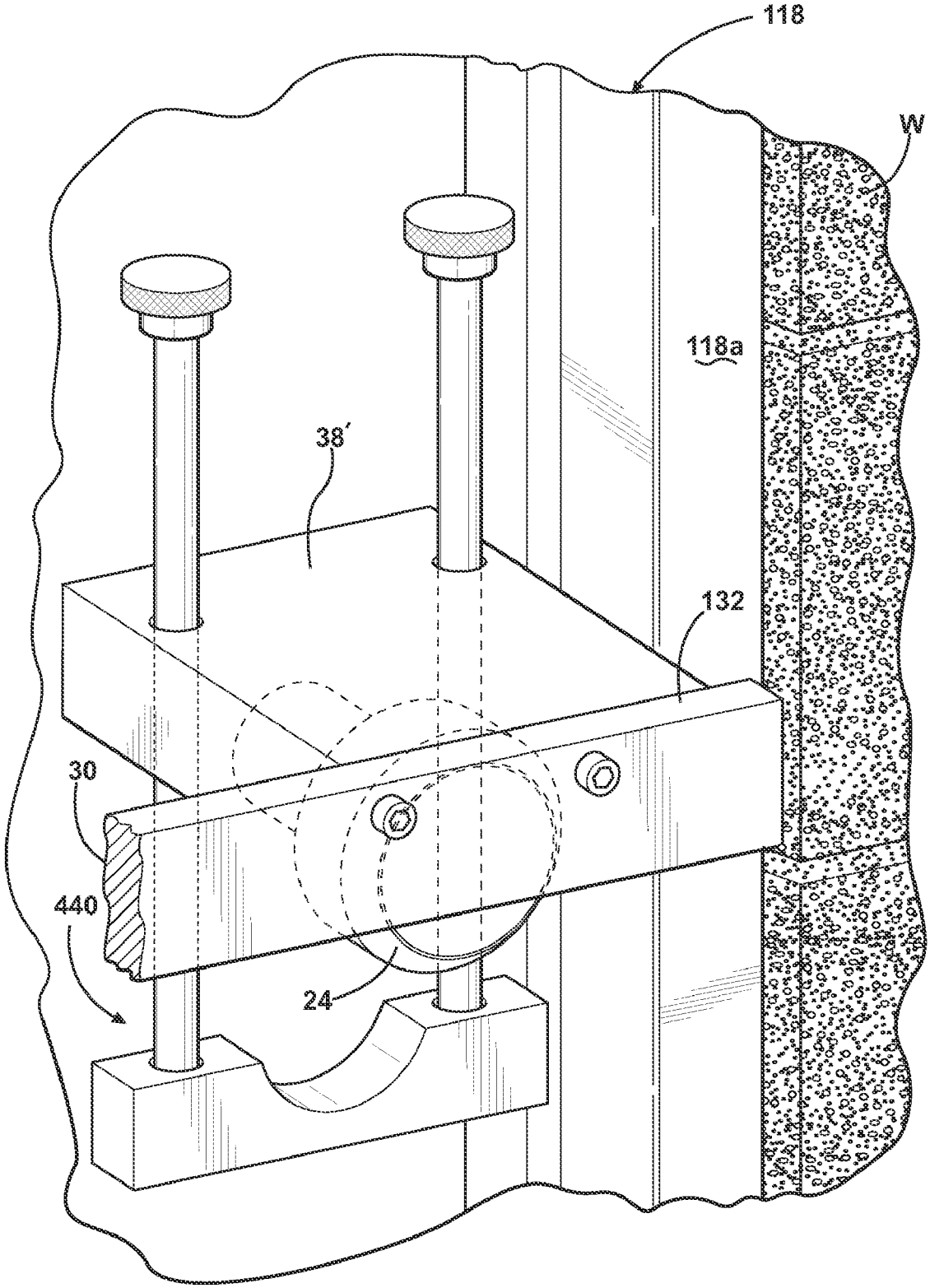
FIG. 11 is a perspective view of an alternate embodiment of a locking bar according to the invention, in use with a recessed doorframe.

FIG. 11 shows a doorway with a doorframe 118 recessed into a wall W defining the doorway, and with recessed sides 118*a* (only one side of the doorway is shown in FIG. 11, the opposite side being identical). Bar 30 is modified with ends 132 adapted to fit within the recessed doorway, with a relatively close fit (for example on the order of two millimeters' tolerance) between the opposing sides of wall W in order to achieve a non-rotating fit in the doorway when pressed against doorframe sides 118*a* with platform plate 38' resting on the doorknob 24. The clamping mechanism can then be operated in the manner as described above. Clamping mechanism 440 is shown by way of example, but any of the clamping mechanisms described and illustrated above would work. Platform plate 38' shown in FIGS. 10B, 10C, and 11 is thicker than the platform plates shown in earlier Figures, in order to provide longer sliding bores for the vertical legs of the clamping member.

Figure 12A:
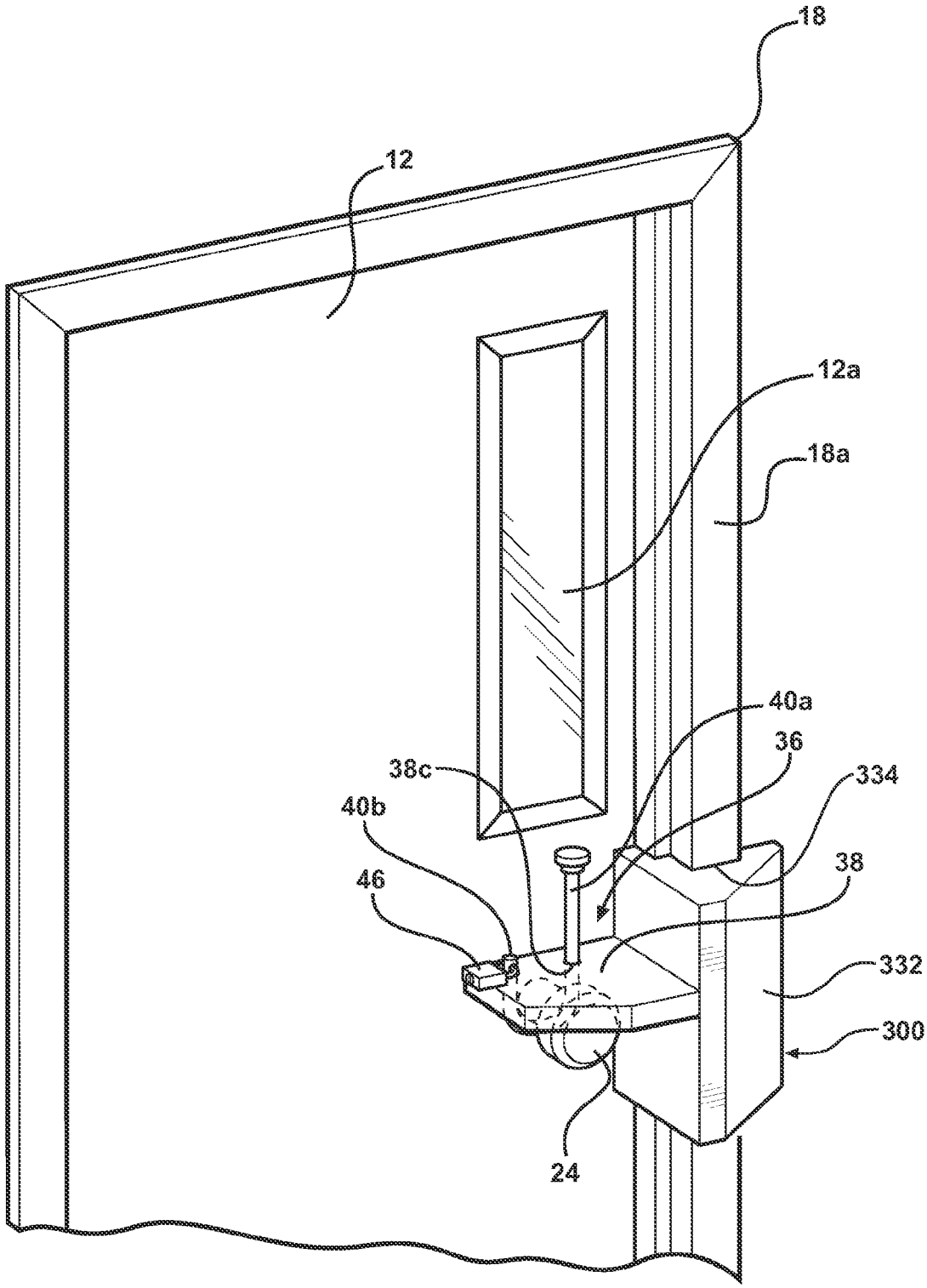
FIGS. 12A-12B are perspective views of alternate embodiments of a locking bar according to the invention, in which the bar engages only one side of the doorframe.
Figure 12B:
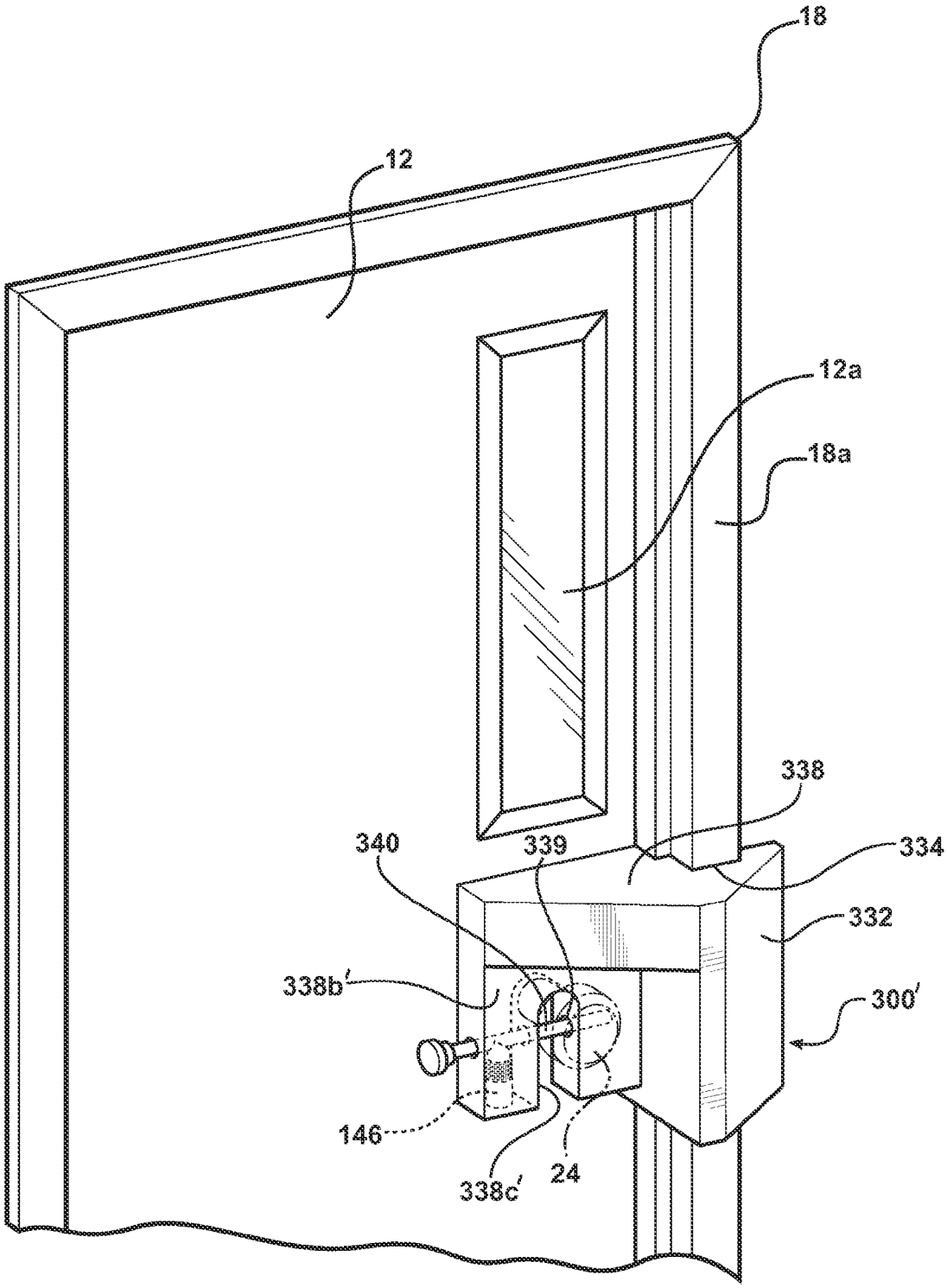

FIGS. 12A and 12B show modified barricade bars 300 and 300', applied to the doorframe and clamped in a manner similar to the bar 30 shown in earlier Figures, but shortened in length, and their doorframe-engaging ends extended in height, to engage only one side of the doorframe 118. The clamping mechanism and operation of the "one-sided" bars 300 and 300' is otherwise similar to bar 30 as described above, except that the fit of the recess or contour 334 in the doorframe-engaging end 332 should more fully match and wrap around the contour of the doorframe. This closely-contoured, wrap-around fit to the doorframe, coupled with the increase in surface area engaging the doorframe due to the extended height of the doorframe-engaging end of the bar, would better resist the leverage generated through the doorknob at the other end. It also would serve to resist rotation of the bar relative to the doorframe.

FIG. 12B shows a further variation of the one-sided bar 300, with modified bar 300' having a modified doorknob-engaging platform 338, with a downwardly-extending flange 338*b'* having a downwardly-opening slot 338*c'* shaped and positioned to fit over the doorknob stem, similar to the flange structure 338*b* and 338*c* in FIG. 9. A transverse clamping member 340, in the illustrated example a transverse sliding pin locked with an internal detent or regular padlock such as 46, replaces the U-shaped clamping member shown in the preceding Figures. Pin 340 slides back and forth in appropriate bores 339 formed in the flange portion 338*c'* to vertically clamp the bar to the doorknob 24, preventing the bar from being lifted off the doorknob. Transverse pin 340 slides underneath the doorknob stem, and is preferably sized and shaped to have a wedge fit against the back face of the knob when pushed all the way in, for the additional advantages described above in relation to the clamping members of FIGS. 1-11. The modified bar 300' also exhibits a thickened doorknob-engaging platform 338 relative to the platform 38 in FIG. 12A, in order to strengthen and better unify the junction of the platform 338 with the doorframe-engaging end 332. While pin 340 is shown as being generally horizontal, it could also be set to be inserted and engaged with the underside of the doorknob at an acute angle, for example sliding into flange 338*b'* and underneath the doorknob stem at a 45-degree angle from the upper left side of flange, allowing gravity to assist the clamping operation.

FIGS. 12A and 12B show doorknob-engaging platforms 38 and 338 that form most or all of the horizontal doorframe-spanning portions of their respective "one-sided" bars 300 and 300', which are significantly shorter than their "two-sided" counterparts that span the entire doorway and engage both sides of the doorframe in the earlier Figures. This makes bars 300 and 300' easier to store; it also makes them well-suited to being manufactured in a single piece, for example by molding from suitable plastics, although all of the barricade bar embodiments disclosed herein are capable of having their horizontal bar portions and doorknob-engaging platform portions formed in a single piece if desired. It should also be understood that the transverse clamping pin 340 of FIG. 12B could be applied to the previous examples of barricade bar using a downwardly-extending flange such as 338*b*, in place of the U-shaped clamping members.

Figure 13:
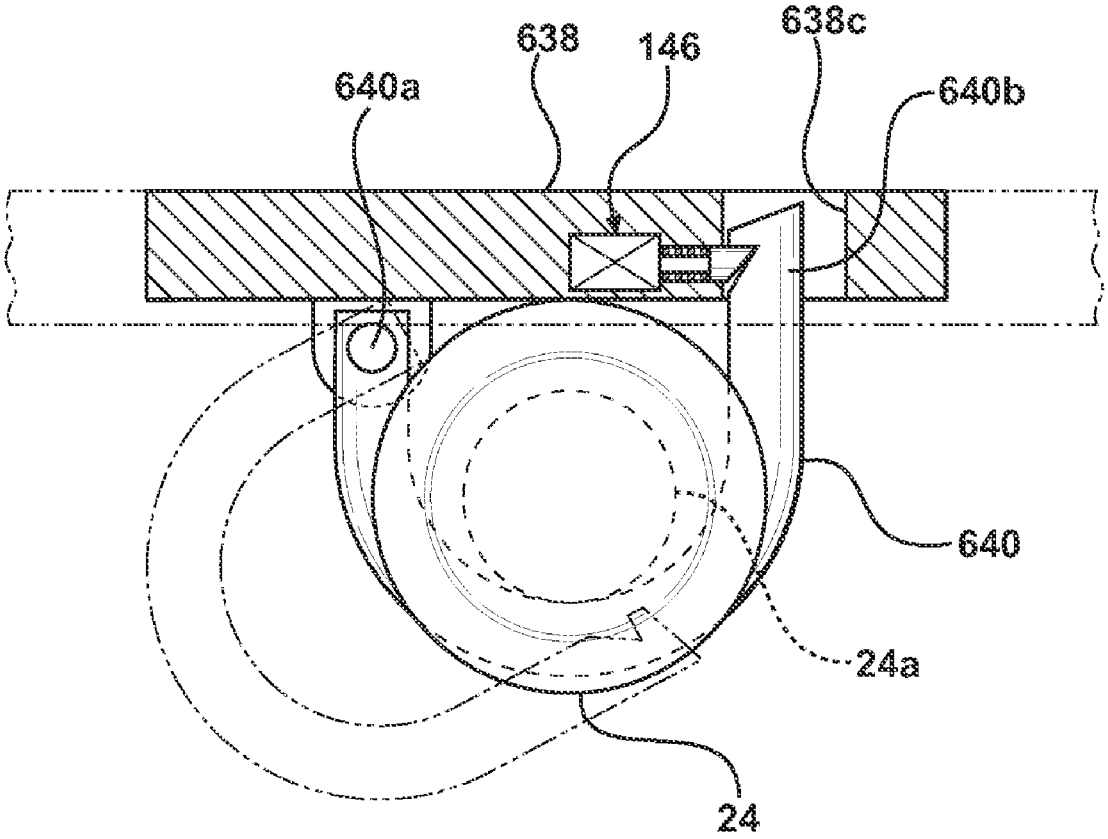
FIG. 13 is a front elevation view of a hinged embodiment of the clamping member.

While the clamping members illustrated above have all shown a preferred sliding adjustment on the extension plate to clamp the doorknob, other forms of clamping movement are possible. Referring to FIG. 13, a J-shaped clamping member such as 640 could be hinged to the underside of an extension plate 638 as shown at 640*a*. The weight and balance of clamping member 640 would preferably cause it to normally hang out of alignment with doorknob 24. The clamping member 640 would then be swung up into clamping engagement with doorknob stem 24*a* when the barricade bar has been positioned, and the free leg 640*b* of the clamping member could then be locked in place in opening 638*c* using an automatic detent 146 or a padlock or other locking mechanism.

Figure 14A:
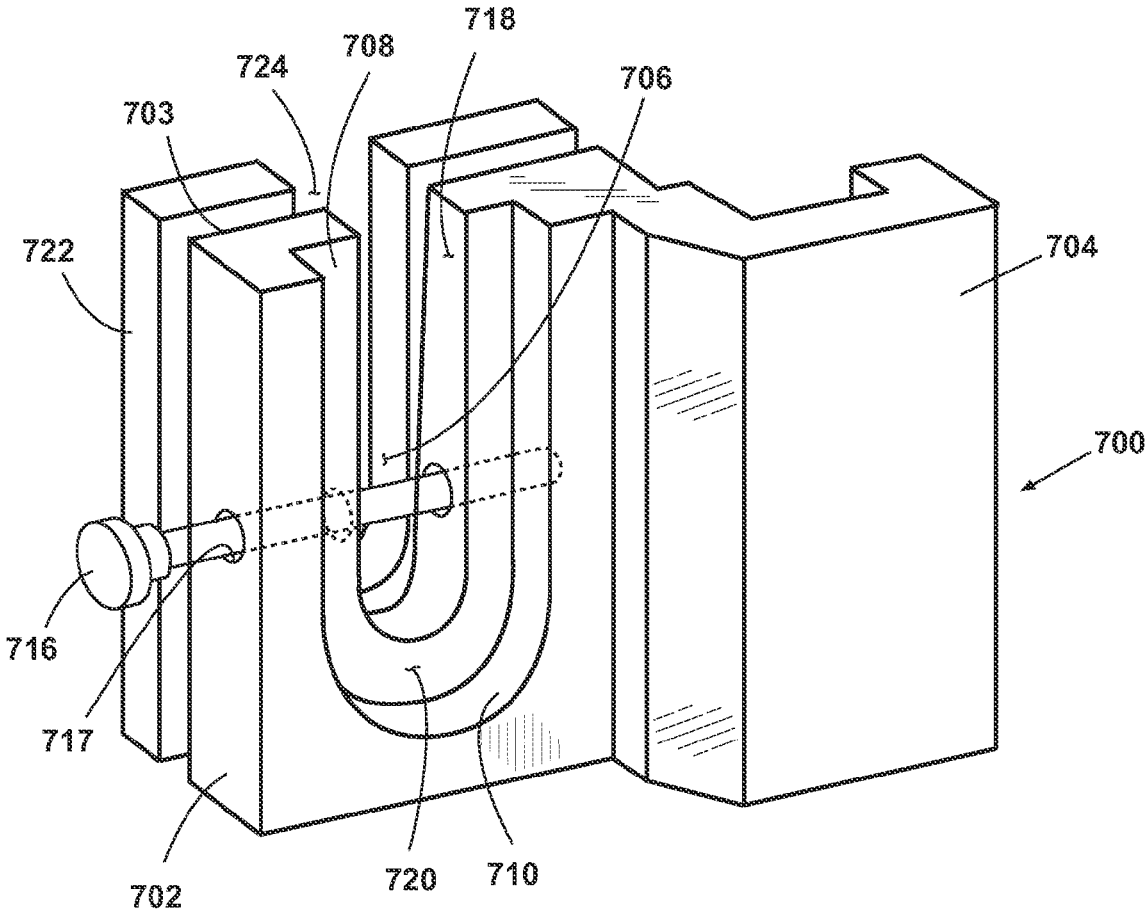
FIG. 14A is an exploded view of a further alternate embodiment of a locking bar according to the invention, in which the bar engages one side of the doorframe.
Figure 14B:
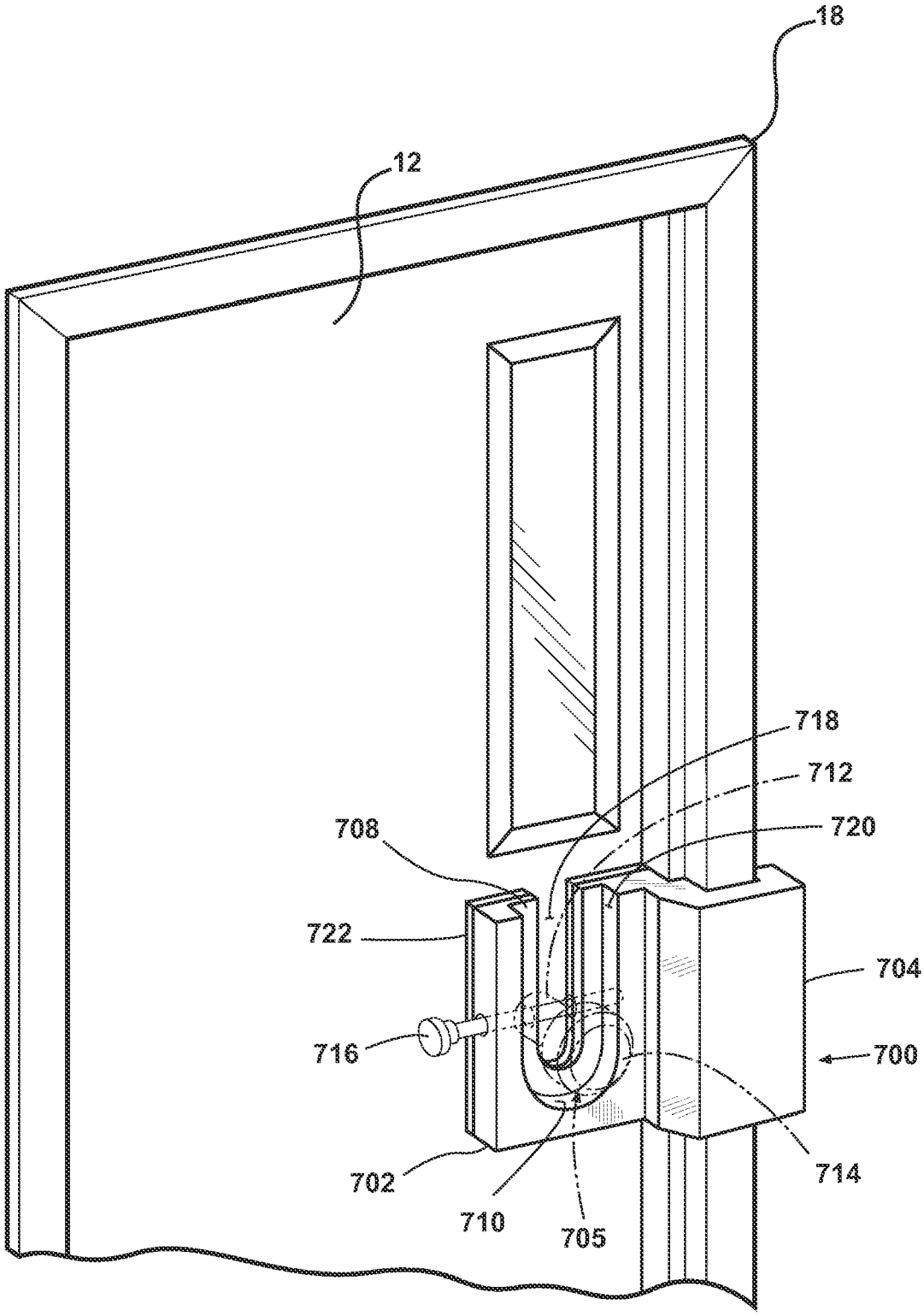
FIG. 14B is a perspective view of the locking bar illustrated in FIG. 14A installed to a door and doorframe in a first configuration.
Figure 14C:
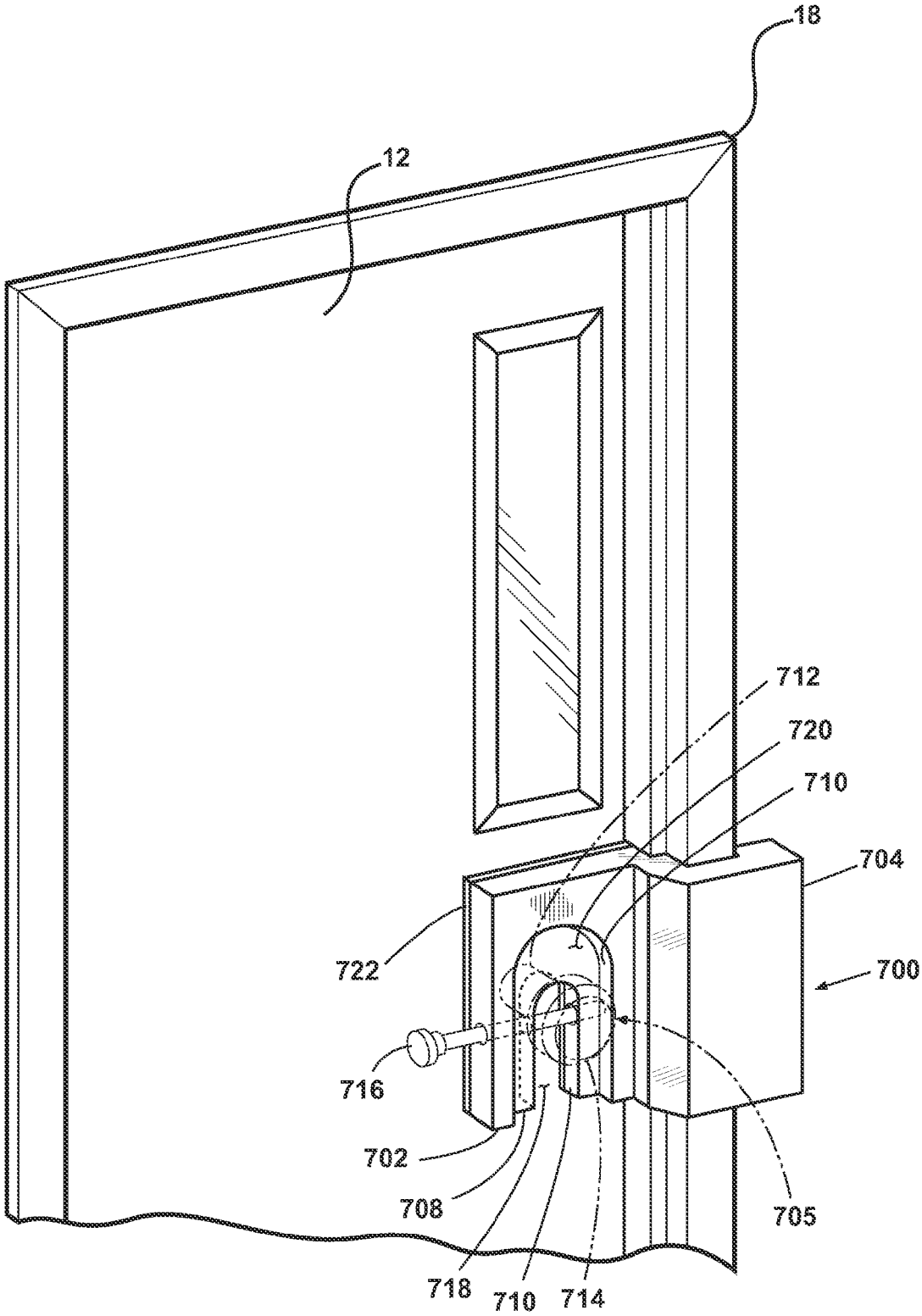
FIG. 14C is a perspective view of the locking bar illustrated in FIG. 14A installed to a door and doorframe in a second configuration.

FIGS. 14A-C show an alternate embodiment of a one-sided bar 700 for use with a door 12 having a latching apparatus, illustrated herein as a doorknob 705. The one-sided bar 700 comprises a modified doorknob-engaging flange member 702 for engaging the doorknob 705, rigidly coupled with a doorframe-engaging frame member 704 similar to the doorframe-engaging end 332. The one-sided bar 700 is illustrated as coupled with the exemplary doorknob 705, although the one-sided bar 700 can similarly be utilized with a door 12 having a lever-type latching apparatus (not shown).

The doorknob-engaging flange member 702 has a rear surface 703 for facing the door 12, and is penetrated by an elongated stepped slot 706 open at one end. As illustrated in FIG. 14A, a longitudinal axis of the stepped slot 706 is parallel to a longitudinal axis of the frame member 704. The slot 706 can be laterally stepped to define a U-shaped distal wall 708 defining a stem slot 718, and transitioning to a U-shaped perimeter wall 710 defining a knob slot 720. The perimeter wall 710 extends orthogonally away from the distal wall 708, and the stem slot 718 can have a configuration symmetrical with and complementary to the knob slot 720.

The flange member 702 can be provided with a retainer, such as a removable retaining pin 716 adapted for insertion in a bore 717 laterally penetrating the distal wall 708 to intersect the stem slot 718. The pin 716 can be biased toward the stem slot 718 by a suitable biasing member (not shown), such as a coil spring, leaf spring, magnetic device, and the like. The bore 717 can be adapted with a length and diameter suitable for receiving the retaining pin 716. The bore 717 can also be spaced away from the closed end of the stem slot 718 to enable a doorknob stem 712 to extend therebetween, as illustrated in FIGS. 14B and 14C. Alternatively, one of the other retaining devices previously described herein can be suitably adapted for retaining the doorknob stem 712 in the stem slot 718. Alternatively, a retainer can be similarly associated with the knob slot 720 to retain a knob-top therein.

The flange member 702 can be adapted with a motorized retraction assembly (not shown) for retracting the retainer away from the stem slot 718 or knob slot 720 when it is desired to remove the one-sided bar 700 from the door 12. For example, the flange member 702 can be provided with a housing or cavity for enclosing a solenoid actuator coupled with the retainer for selectively moving the retainer. As generally illustrated in FIG. 5, the solenoid actuator can be coupled with a wireless receiver 152*c* and a controller or microprocessor 152*a* for moving the retainer in response to a signal transmitted by a wireless transmitter 152*b*. Other assemblies suitable for selectively moving the retainer to facilitate installation and removal of the one-sided bar 700 relative to the door 12 will be evident to a person of ordinary skill.

The doorframe-engaging frame member 704 can be adapted to "wrap around" the door frame 18 so that the one-sided bar 700 can coordinately engage the door frame 18 while preventing lateral or rotational movement of the one-sided bar 700 relative to the door frame 18. The one-sided bar 700 can also comprise a generally plate-like removable spacer 722 with a spacer slot 724 having a configuration symmetrical with and complementary to the stem slot 718. The spacer 722 can be adapted for coupling with the flange member 702 intermediate the face of the door 12 and the rear surface 703, such as by pins, screws, and the like. The purpose of the spacer 722 is to occupy any space intermediate the rear surface 703 and the face of the door 12 so that, when the one-sided bar 700 is installed, there is uninterrupted contact of the one-sided bar 700 with the door 12 and frame 18.

The doorknob-engaging flange member 702 and elongated stepped slot 706 can be configured to closely engage the doorknob stem 712 and a knob-top 714, as illustrated in FIGS. 14B and 14C. The stem slot 718 can have a width somewhat greater than the diameter of the doorknob stem 712 to enable the stem slot 718 to slidably engage the doorknob stem 712 when the one-sided bar 700 is installed. Similarly, the knob slot 720 can have a width somewhat greater than the diameter of the knob-top 714 to enable the knob slot 720 to slidably engage the knob-top 714 when the one-sided bar 700 is installed. Additionally, the configuration of the one-sided bar 700, particularly the depth of the flange member 702 and the spacer 722, can be adapted so that the knob-top 714 slidably engages the distal wall 708 when the one-sided bar 700 is installed. This will result in a one-sided bar that is relatively immovably coupled with the door frame 18 and the door 12, which will facilitate both the proper positioning of the one-sided bar 700 and the secure retention of the door 12 in a closed, immovable condition.

As illustrated in FIG. 14B, the one-sided bar 700 can be configured for installation from below the doorknob 705. The pin 716 can be utilized after the one-sided bar 700 is installed to secure the one-sided bar 700 to the door 12. It is anticipated, however, that depending on the close engagement of the one-sided bar 700 with the doorknob 705 and the frame 18, the one-sided bar 700 can effectively remain coupled with the door 12 without the pin 716 installed. However, it is expected that the pin 716 will be utilized to ensure that the one-sided bar 700 remains in proper position relative to the door 12 and the frame 18.

FIG. 14C illustrates the one-sided bar 700 installed in an alternate configuration from above the doorknob 705. The pin 716 can be utilized after the one-sided bar 700 is installed to further minimize the potential for the one-sided bar 700 to somehow become separated from the door 12. Alternatively, the pin 716 can be omitted without substantially reducing the effectiveness of the one-sided bar 700 in locking the door 12.

The configuration of the one-sided bar 700 to accommodate either an upward or downward installation enables a single configuration to be used with either left-hand doors, as shown in FIGS. 14B and 14C, or right-hand doors. To switch from one door to another, it is only necessary to rotate the one-sided bar 700 by 180°.

The one-sided bar 700 can be fabricated from metallic or non-metallic components having a suitable strength and durability for the purposes described herein. Alternatively, the one-sided bar 700 can be fabricated in a single piece, such as by casting or molding.

Figure 14D:
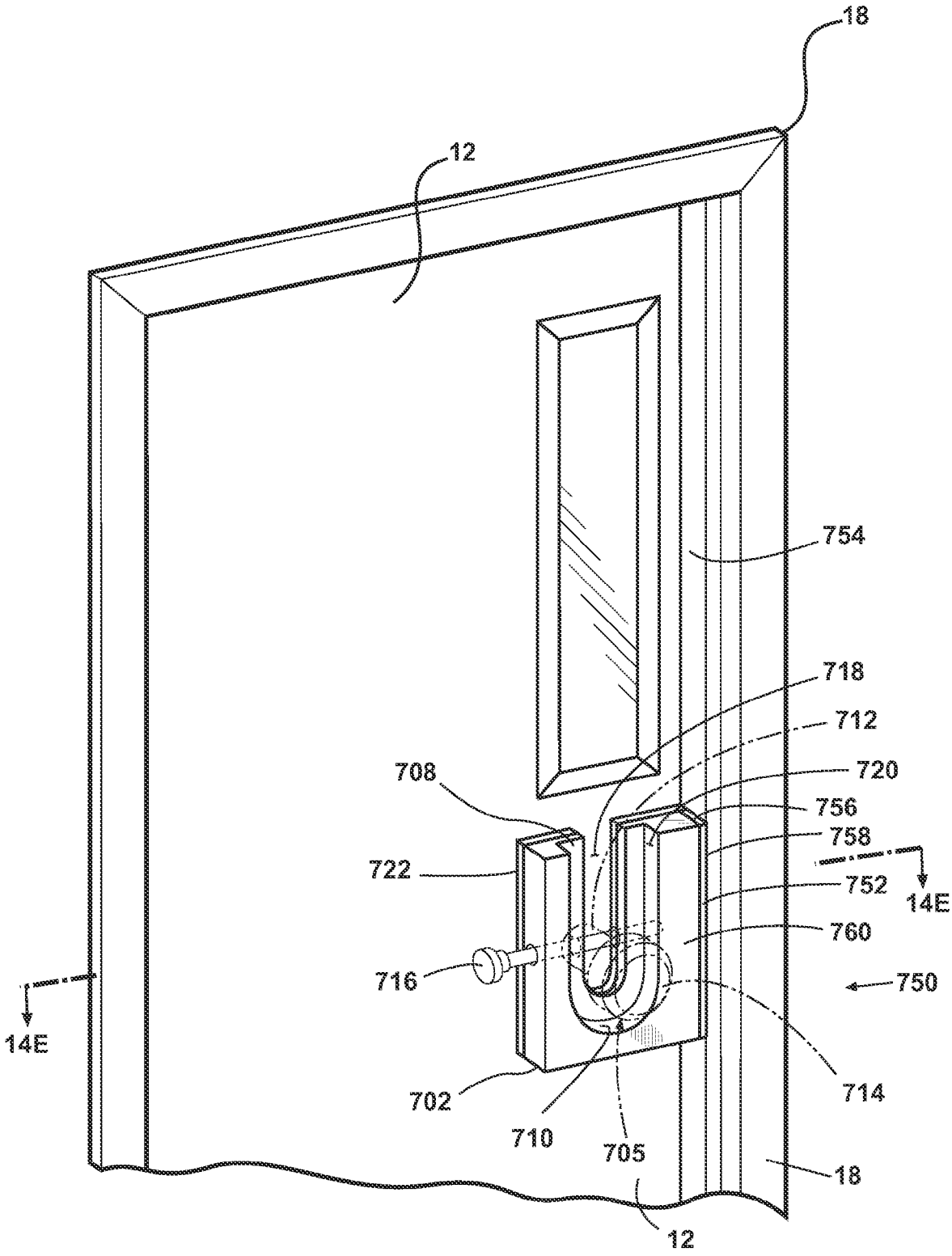
FIG. 14D is a perspective view of an alternate embodiment of the locking bar illustrated in FIG. 14A installed to a door and doorframe.

FIG. 14D illustrates an alternate embodiment 750 which is identical to the one-sided bar 700 except that the one-sided bar 750 includes an alternately configured doorframe-engaging frame member 760, and a second spacer 752. The spacer 752 is inserted between the outer face 756 of the frame member 760 and the inner face 754 of the doorframe 18 so that the one-sided bar 750 is held tightly against the inner face 754. In order to maintain this tight contact, the stem slot 718 must tightly register with the doorknob stem 712. When assembled to the door 12, the one-sided bar 750 will be prevented from lateral movement by the cooperating registry of the doorknob stem 712, the stem slot 718, the outer face 756, the spacer 752, and the inner face 754. The absence of lateral movement will prevent the door 12 from being opened, as follows.

Figure 14E:
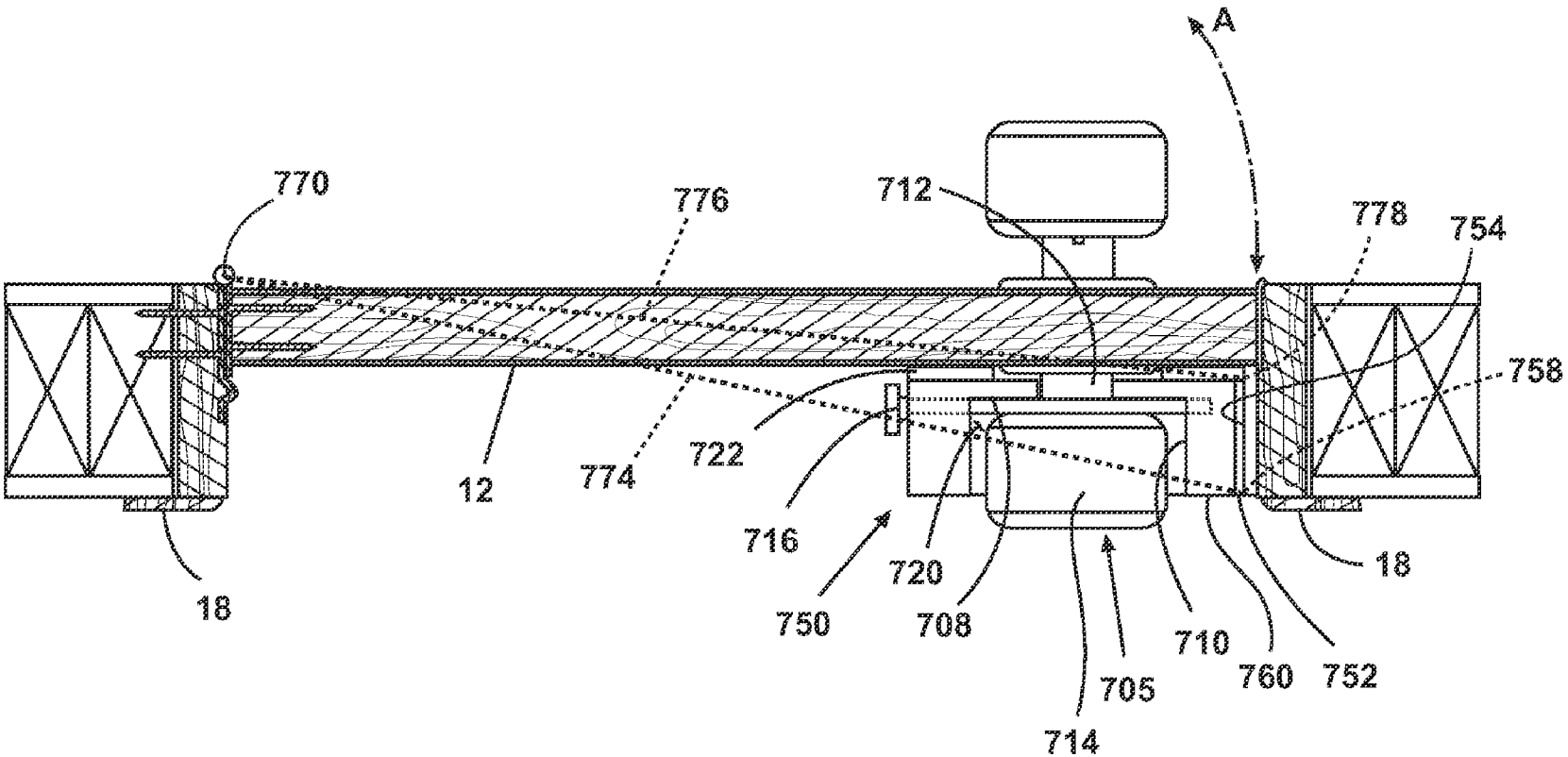
FIG. 14E is a sectional view taken along line 14E-14E of FIG. 14D.

Referring also to FIG. 14E, it will be readily understood that the door 12 rotates between open and closed positions about a vertical axis 770 defined by the hinge pins. This rotation results in the edge 772 of the door 12 adjacent the doorframe 18, and the attached one-sided bar 750, moving in an arc "A." If the one-sided bar 750 is fixedly attached to the door 12 as described above, so that the spacer 752 tightly engages the inner face 754 of the doorframe 18 and the one-sided bar 750 is unable to translate horizontally relative to the door 12, it will not be possible for the door 12 to be opened. The arcuate motion of the one-sided bar 750 will tend to drive the spacer 752 against the inner face 754, thereby preventing movement of the door 12. Another way of looking at it is that the distance 774, i.e. the radius, from the vertical axis 770 to the edge 758 of the spacer 752, which defines a second outside corner, is somewhat greater than the distance 776 from the vertical axis 770 to the edge 778 of the spacer 752, which defines a first inside corner. Any attempt to rotate the door 12 to an open position will result in interference of the inner face 754 with the edge 758, and consequent "jamming" of the door in the closed position.

The one-sided bar 700 has been described with respect to an exemplary doorknob 705 with which the one-sided bar 700 is coupled. However, the one-sided bar 700 can be coupled with alternate latching apparatuses, such as lever handles, with suitable adaptations of the one-sided bar 700, such as the stem slot 718 and the knob slot 720, to accommodate a lever handle.

It will be understood that, although the barricade bar has been described in its preferred use for an institutional lockdown procedure, it can be used to barricade similar doors in different situations. While the barricade bar has been described in connection with its primary role as a barricade to bar an intruder from entering a room or building with an outward-opening door, it might also be used to barricade someone inside a room or building with an inward-opening door, with the terms "outward-opening" and "inner" and "inside" being considered relative to the person employing the barricade bar.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A barricade bar for maintaining a door in a closed configuration, the door including a first side, an opposed second side, and a door latching apparatus including a stem extending orthogonally away from the second side, the first side being oriented in a direction toward which the door opens, the door being hingedly mounted for rotational movement between the closed configuration and an open configuration in a door frame having at least one vertical member, the barricade bar comprising:

a flange member including a first generally U-shaped slot extending therethrough characterized by a first longitudinal axis and a first width, in parallel disposition with a second generally U-shaped slot extending therethrough characterized by a second longitudinal axis collinear with the first longitudinal axis and a second width greater than the first width, the first slot adapted for slidably engaging a latching apparatus stem to prevent unintended separation of the flange member from a latching apparatus; and a frame member for coordinate engagement with the at least one door frame vertical member, the frame member and the flange member forming an unbroken whole;

wherein the barricade bar can abut a second side of a door and at least one door frame vertical member so that the frame member immovably engages at least one door frame vertical member, and the U-shaped slot immovably engages a latching apparatus stem to prevent the opening of a door.

2. The barricade bar according to claim 1 wherein the frame member has a surface complementary to the at least one vertical member for slidably engaging the at least one vertical member.

3. The barricade bar according to claim 1 wherein the latching apparatus comprises a stem and a knob-top, and the flange member comprises at least one slot for receiving at least one of the stem and the knob-top.

4. The barricade bar according to claim 3 wherein the at least one slot comprises a first slot for receiving the stem and a second slot for receiving the knob-top.

5. The barricade bar according to claim 3, and further comprising a movable retainer for engaging the stem to prevent the separation of the stem from the flange member.

6. The barricade bar according to claim 3, and further comprising a movable retainer for engaging the stem to prevent the separation of the stem from the at least one slot.

7. The barricade bar according to claim 3, and further comprising a biasing member for biasing the movable retainer toward the at least one slot.

8. The barricade bar according to claim 7 wherein the biasing member comprises a solenoid-driven actuator.

9. The barricade bar according to claim 8, and further comprising a wireless transmitter, a controller, and a wireless receiver coupled with the actuator for selectively moving the retainer in response to signals transmitted by the wireless transmitter to the wireless receiver.

10. The barricade bar according to claim 1, and further comprising a spacer for spacing the flange member away from the second side of the door when the frame member is engaged with the at least one vertical member to provide uninterrupted engagement of the barricade bar with the door and the door frame.

11. The barricade bar according to claim 1 wherein the flange member can engage the latching apparatus from above the latching apparatus.

12. The barricade bar according to claim 1 wherein the flange member can engage the latching apparatus from beneath the latching apparatus.

13. The barricade bar according to claim 1, and further comprising a spacer for spacing the flange member away from the door frame when the frame member is engaged with the at least one vertical member to provide uninterrupted engagement of the barricade bar with the door and the door frame.

14. A barricade bar for maintaining a door in a closed configuration, the door having a first side, an opposed second side, and a door latching apparatus including a stem extending orthogonally away from the second side, the first side being oriented in a direction toward which the door opens, the door being hingedly mounted for rotational movement between the closed configuration and an open configuration in a door frame including at least one vertical member, the barricade bar comprising:

a door handle-engaging member including a first face for abutting disposition against one of the second surface and a first removable spacer, and a stepped slot including a stem slot for slidably-engaging a stem of the door handle and a knob slot having a width greater than the stem slot width for engaging a knob of the door handle; and a door frame-engaging member generally orthogonal to the door handle-engaging member, including a second outer face for abutting disposition against one of the at least one vertical member and a second removable spacer, the door frame-engaging member and the door handle-engaging member forming an unbroken whole;

wherein when the door handle-engaging member is positioned against one of the second surface and the first removable spacer and the door frame-engaging member is in abutting disposition with one of the at least one vertical member and the second removable spacer so that the barricade bar is immovably retained against the stem and the one of the at least one vertical member and the second removable spacer, the door is prevented from opening.

15. A barricade bar for maintaining a door in a closed configuration, the door having a first side oriented in a direction toward which the door opens, an opposed second side, and a door handle stem extending orthogonally away from the second side, the door being hingedly mounted for rotational movement in a door frame having at least one vertical member, the at least one vertical member and the second side defining an inside corner when the door is closed, the hinged mounting defining an axis of rotation, the barricade bar comprising:

a generally planar flange member including a generally U-shaped slot extending therethrough adapted for slidably receiving a door handle stem therein and urging the barricade bar toward an at least one vertical member; and a frame member including a first outside corner for abutting disposition with an inside corner defined by the intersection of the at least one vertical member and the second side, and a second outside corner parallel to the first outside corner and separated therefrom by a planar surface orthogonal to the flange member, the distance between the axis of rotation and the first outside corner defining a first radius of rotation and the distance between the axis of rotation and the second outside corner defining a second radius of rotation, the second radius of rotation being greater than the first radius of rotation;

wherein when the barricade bar is engaged with the second side of a door so that the frame member engages an at least one vertical member and the flange member engages a latching apparatus, rotation of a door to an open configuration will be prevented as a result of the second radius of rotation being greater than the first radius of rotation.

* * * * *